US012577795B2

(12) United States Patent
Walker et al.

(10) Patent No.: US 12,577,795 B2
(45) Date of Patent: Mar. 17, 2026

(54) MOTORIZED SYSTEM FOR SCAFFOLD

(71) Applicant: METALTECH-OMEGA INC., Laval (CA)

(72) Inventors: Alexandre Walker, Laval (CA); Patrice Béland, Laval (CA); Francis Goyer, Laval (CA)

(73) Assignee: METALTECH-OMEGA INC., Laval (CA)

( * ) Notice: Subject to any disclaimer, the term of this patent is extended or adjusted under 35 U.S.C. 154(b) by 687 days.

(21) Appl. No.: 18/048,777

(22) Filed: Oct. 21, 2022

(65) Prior Publication Data

US 2024/0133189 A1 Apr. 25, 2024
US 2024/0229478 A9 Jul. 11, 2024

(51) Int. Cl.
*E04G 1/24* (2006.01)

(52) U.S. Cl.
CPC ..... *E04G 1/24* (2013.01); *E04G 2001/242* (2013.01)

(58) Field of Classification Search
CPC ..... E04G 1/24; E04G 2001/242
USPC ..... 701/22
See application file for complete search history.

(56) References Cited

U.S. PATENT DOCUMENTS 3,502,172 A * 3/1970 Ismond ..... B60P 3/14 180/440
3,731,758 A * 5/1973 Hibma ..... E04G 1/24 180/443
3,930,548 A * 1/1976 Wallraff ..... B60P 3/14 180/65.6
4,275,797 A * 6/1981 Johnson ..... E04G 1/24 182/16
4,475,611 A * 10/1984 Fisher ..... B60L 50/66 182/13
6,076,621 A * 6/2000 Horn ..... B62D 51/00 180/320
6,533,067 B2 3/2003 Chick
6,880,672 B2 * 4/2005 Imberi ..... E04G 1/24 182/16
7,004,248 B2 2/2006 Hoffman et al.
(Continued)

FOREIGN PATENT DOCUMENTS

CA 3179633 C 7/2025
CN 218264842 U * 1/2023

OTHER PUBLICATIONS

"Power Snappy, Motorized Work Platform," Granite Industries, Dec. 14, 2020, 4 pages.

(Continued)

*Primary Examiner* — Kambiz Abdi
(74) *Attorney, Agent, or Firm* — Sheridan Ross P.C.

(57) ABSTRACT

A scaffold motorization system for motorizing a scaffold and a method for motorizing a scaffold. The scaffold may include one or more platforms and a set of legs supporting the one of more platforms. The scaffold motorization system may comprise: a set of wheel assemblies configured to be releasably mounted to at least some legs in the set of legs of the scaffold, the set of wheel assemblies including a set of wheels and at least one motor configured to drive wheels in the set of wheels; and a controller in communication with the set of wheel assemblies for controlling the least one motor to drive the wheels in the set of wheels at least in part in response to control signals received from a control device operated by a person.

20 Claims, 24 Drawing Sheets

(56) References Cited

U.S. PATENT DOCUMENTS

| | | | | |
|---|---|---|---|---|
| 7,228,936 | B2 * | 6/2007 | Wyse | E06C 1/39 182/12 |
| 8,434,592 | B1 * | 5/2013 | Young | E04G 1/24 182/12 |
| 9,574,356 | B2 * | 2/2017 | Jutte | E06C 5/02 |
| 9,903,126 | B2 * | 2/2018 | Rowsome | E04G 1/22 |
| 2004/0231917 | A1 | 11/2004 | Chick | |
| 2016/0362284 | A1 * | 12/2016 | Haessler | B66F 11/04 |

OTHER PUBLICATIONS

Conditonal Notice of allowance issued on May 30, 2024 in the Canadian patent application No. 3,179,633—3 pages.

* cited by examiner

MOTORIZED SYSTEM FOR SCAFFOLD

TECHNICAL FIELD

The subject matter disclosed generally relates to scaffolds. More particularly, the subject matter disclosed relates to systems, devices and methods for providing mobility to a scaffold, for example Baker type scaffolds.

BACKGROUND

Mobile scaffolds have been used in the constructions industry for many years. Such scaffolds may be used in interior and exterior situations to provide access for tasks that do not justify the use of fixed scaffolds. Typically known foldaway scaffolds comprise a platform supported at a height above ground level and having a safety guard rail around the platform. In many scaffolding towers, the height of the platform can be adjusted.

In some situations, it may be practical to have mobile scaffolds that are movable based on the needs, for instance when working on ceilings. For instance, a mobile scaffold may include casters to move the scaffold between locations. Once the mobile scaffold is placed at a desirable location, the casters of the scaffold may be locked to prevent the scaffold from moving inadvertently when workers are on the mobile scaffold.

To move the scaffold, one of the workers on the platform must climb down the scaffold to unlock the casters, move the scaffold and then lock the casters, before climbing back up, thus requiring time and efforts. Furthermore, based on the weight of the scaffold and the equipment mounted thereto, the scaffold may be heavy, thus difficult to move.

While some motorised systems have been proposed for providing mobility to a scaffold, such systems tend to be bulky, heavy, complicated to operate and do not provide a suitable level of maneuverability for the scaffold.

In view of the above, it is clear that there is need for an improved system for providing mobility to a scaffold that alleviates at least in part some of the above identified deficiencies.

SUMMARY

This summary is provided to introduce a selection of concepts in a simplified form that are further described below in the Detailed Description. This summary is not intended to identify all key aspects and/or essential aspects of the claimed subject matter.

In accordance with various aspects of this disclosure, there is provided a scaffold motorization system for motorizing a scaffold and a method for motorizing a scaffold. The scaffold may include one or more platforms and a set of legs supporting the one of more platforms. The scaffold motorization system may comprise: a set of wheel assemblies configured to be releasably mounted to at least some legs in the set of legs of the scaffold, the set of wheel assemblies including a set of wheels and at least one motor configured to drive wheels in the set of wheels; and a controller in communication with the set of wheel assemblies for controlling the least one motor to drive the wheels in the set of wheels at least in part in response to control signals received from a control device operated by a person.

For instance, in accordance with an aspect of the disclosure, there is provided a scaffold motorization system for motorizing a scaffold, the scaffold including one or more platforms and a set of legs supporting the one of more platforms, legs in the set of legs being mounted on casters. The scaffold motorization system comprises: a set of wheel assemblies configured to be releasably mounted to at least some legs in the set of legs of the scaffold, the set of wheel assemblies including a set of wheels and at least one motor configured to drive wheels in the set of wheels in a forward direction and a backward direction; and a controller in communication with the set of wheel assemblies for controlling the least one motor to drive the wheels in the set of wheels at least in part in response to control signals received from a control device operated by a person. In response to control signals conveying specific commands received from the control device, the controller is configured to transform the specific commands into corresponding electric signals to power the at least one motor to drive the wheels in the set of wheels in at least one of the forward direction and the backward direction.

In some specific implementations, the set of wheel assemblies may include at least two wheel assemblies. More specifically, in some specific implementations, the at least one motor includes at least two motors, each motor of the at least two motors being connected to a respective wheel assembly from the at least two wheel assemblies.

In some specific implementations, the controller may be configured to transform the specific commands into distinct electric signals independently powering each of the at least two motors in one of the forward direction and the backward direction.

In some specific implementations, the set of wheel assemblies may comprise brakes configured to selectively prevent motion of the set of wheels of the set of wheel assemblies.

In some specific implementations, the scaffold motorization system may further comprise the control device, the control device being in communication with the controller and including a user interface for receiving user input.

In some specific implementations, the control device comprises at least one of: a smartphone, a tablet, and a computer.

In some specific implementations, the control device may be in communication with the controller via a wired connection to convey the control signals.

In some specific implementations, the control device may be in communication via a wireless connection to convey the control signals.

In some specific implementations, the scaffold motorization system may comprise a connector to connect the controller to the power source.

In some specific implementations, the set of wheel assemblies may be configured to be releasably mounted to the at least some legs in the set of legs of the scaffold without removing the casters.

In some specific implementations, each wheel of the set of wheels may be configured to be installed rearwards to a front one of the casters of the scaffold.

In some specific implementations, the wheels of the set of wheels may be configured to be spaced apart by a span that is no longer than a width of the scaffold when the scaffold motorization system is installed on the scaffold.

In some specific implementations, each wheel assembly in the set of wheel assemblies may comprise a frame having a connector for mounting the frame to a respective leg of the scaffold.

In some specific implementations, the controller may be connectable to each of the wheel assemblies when the scaffold motorization system is installed on the scaffold.

In some specific implementations, the scaffold motorization system may be releasable from the scaffold.

In some specific implementations, the scaffold motorization system may be collapsible into at least one portable unit.

In some specific implementations, the controller may include a casing configured to house the control device.

In some specific implementations, the scaffold motorization system may be collapsible into a first unit and a second unit, the first unit comprising the controller and the second unit comprising the set of wheel assemblies.

In accordance with another aspect of the disclosure, there is provided a method of motorizing a scaffold using a removable scaffold motorization system, the scaffold including one or more platforms and a set of legs supporting the one of more platforms, legs in the set of legs being mounted on casters. The removable scaffold motorization system comprises: a set of wheel assemblies configured to be releasably mounted to at least some legs in the set of legs of the scaffold, the set of wheel assemblies including a set of wheels and at least one motor configured to drive wheels in the set of wheels in a forward direction and a backward direction; and a controller in communication with the set of wheel assemblies for controlling the least one motor to drive the wheels in the set of wheels at least in part in response to control signals received from a control device operated by a person. The method comprises the steps of: mounting the set of wheel assemblies to at least some of the legs of the scaffold; mounting the controller to the scaffold and to the set of wheel assemblies; and providing a power source to the controller. The controller is configured to receive control signals conveying specific commands received from a control device, and to transform the specific commands into corresponding electric signals to power the one of more motors to drive the wheels in the set of wheels in at least one of the forward direction and the backward direction.

All features of exemplary embodiments which are described in this disclosure and are not mutually exclusive can be combined with one another. Elements of one embodiment or aspect can be utilized in the other embodiments/aspects without further mention.

These and other aspects of this disclosure will now become apparent to those of ordinary skill in the art upon review of a description of embodiments that follows in conjunction with accompanying drawings.

BRIEF DESCRIPTION OF THE DRAWINGS

The above-mentioned features and objects of the present disclosure will become more apparent with reference to the following description taken in conjunction with the accompanying drawings, wherein like reference numerals denote like elements and in which.

Figure 1:
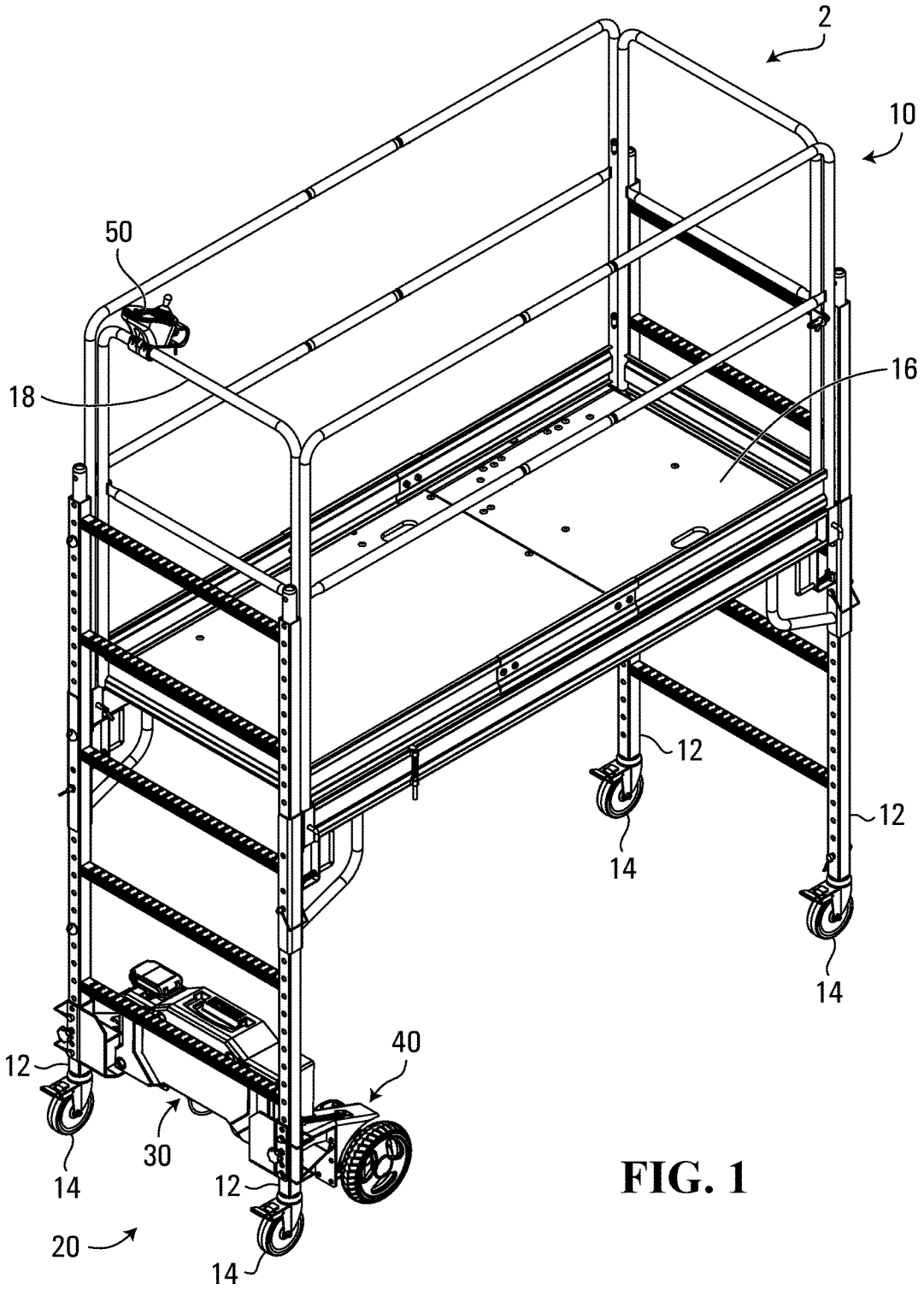
FIG. 1 is a perspective view of a scaffold assembly including a mobile scaffold and a scaffold motorization system, in accordance with an embodiment.
Figure 2:
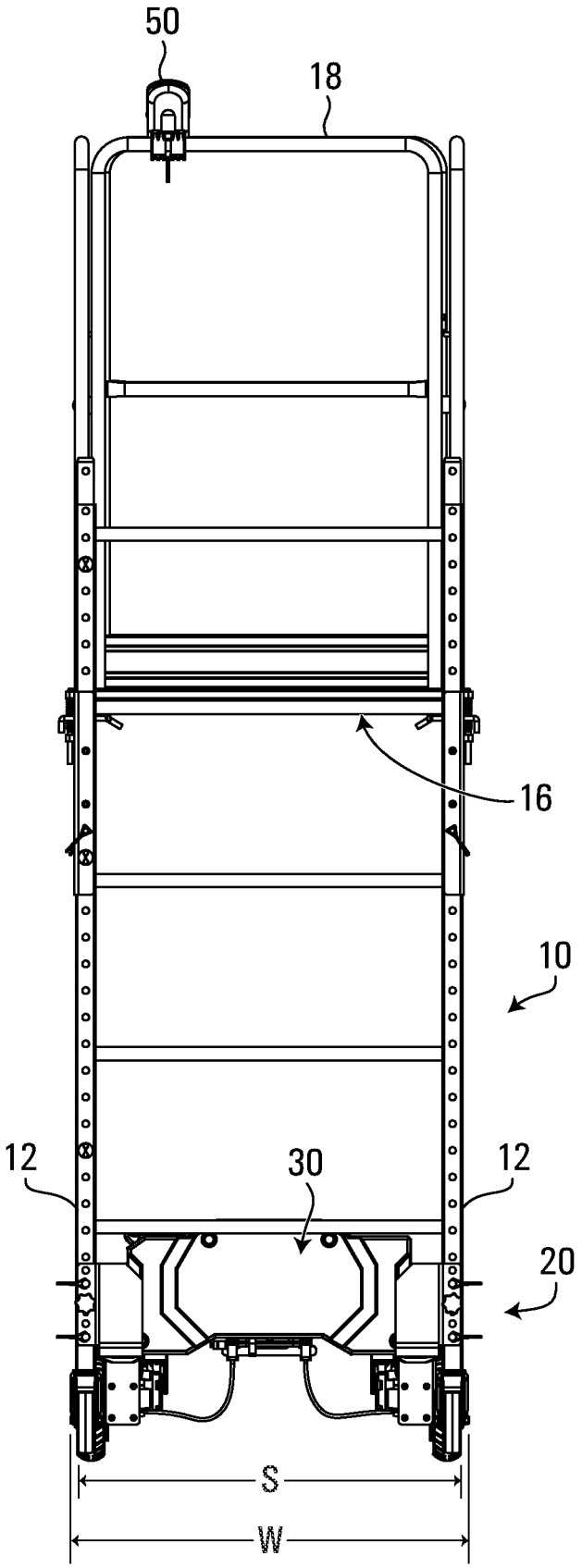
FIG. 2 is a front view of the scaffold assembly of FIG. 1.
Figure 3:
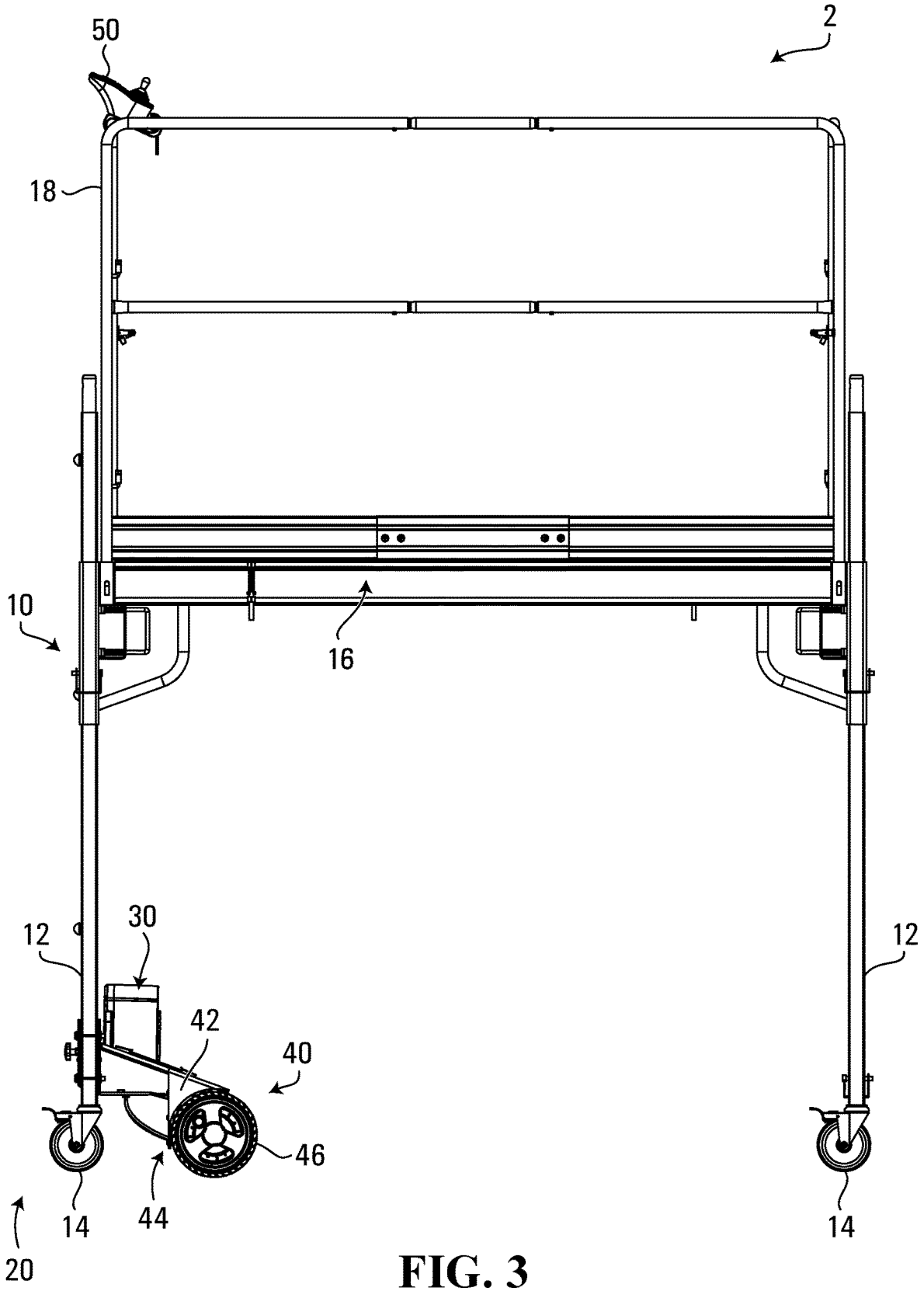
FIG. 3 is a left side elevation view of the scaffold assembly of FIG. 1.
Figure 4:
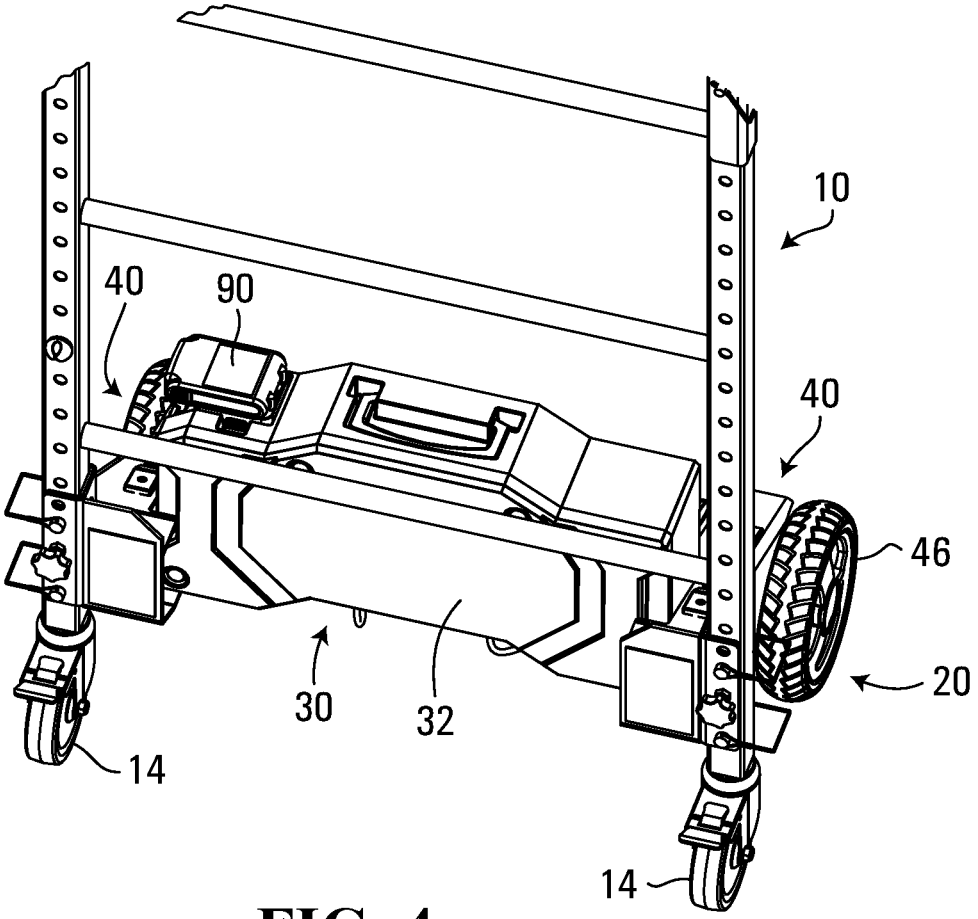
FIG. 4 is an enlarged view of a portion of the scaffold assembly of FIG. 1.
Figure 5:
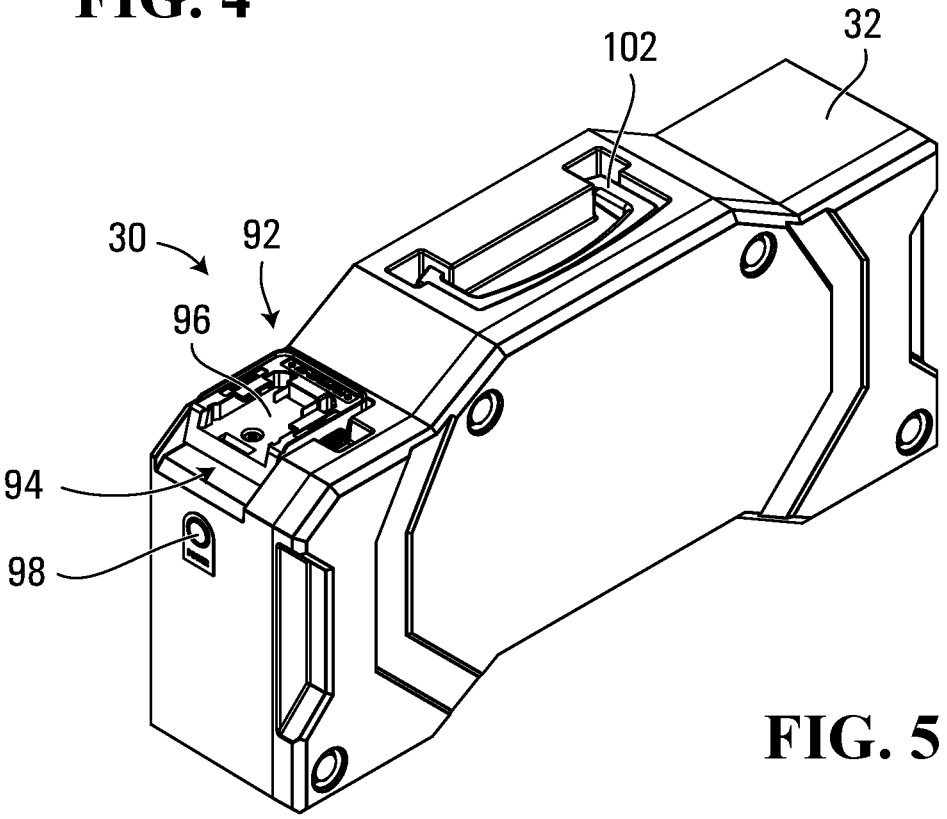
FIG. 5 is a perspective view of a controller of the scaffold motorization system of FIG. 1.
Figure 6:
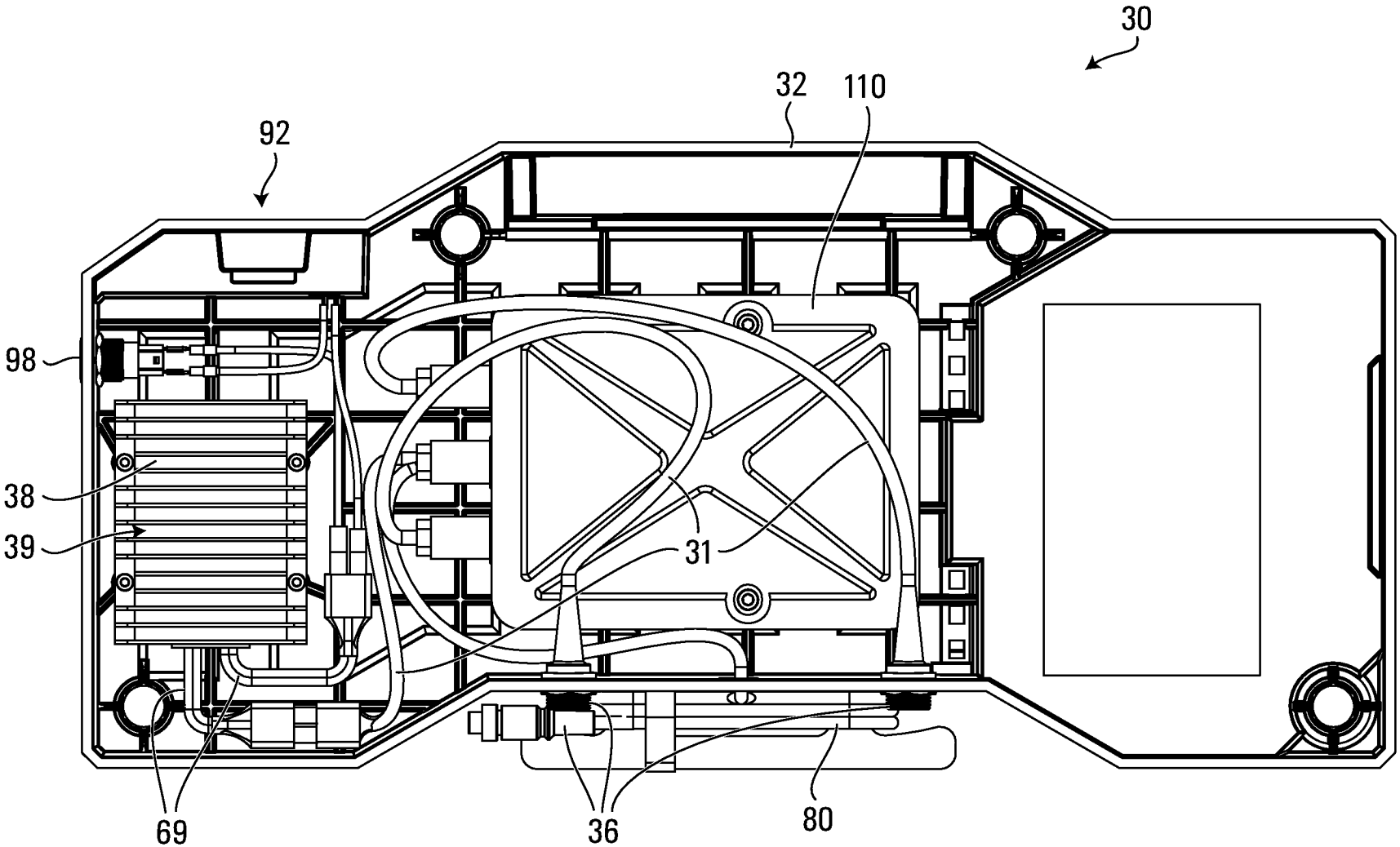
FIG. 6 is an inside view of the controller of FIG. 5.
Figure 7:
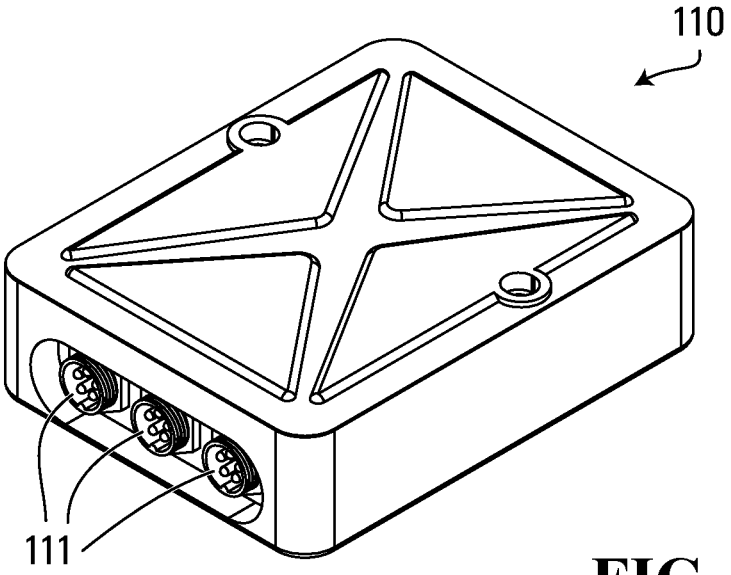
FIG. 7 is a perspective view of a processing system of the controller of FIG. 5.
Figure 8:
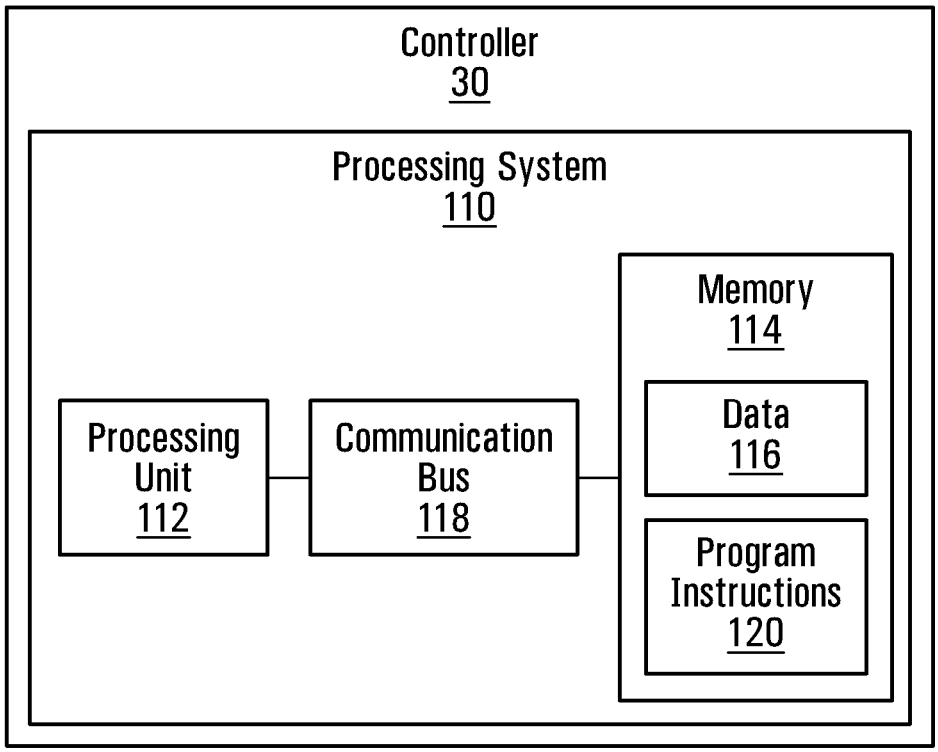
FIG. 8 is a bloc diagram of the processing system of FIG. 7.
Figure 9:
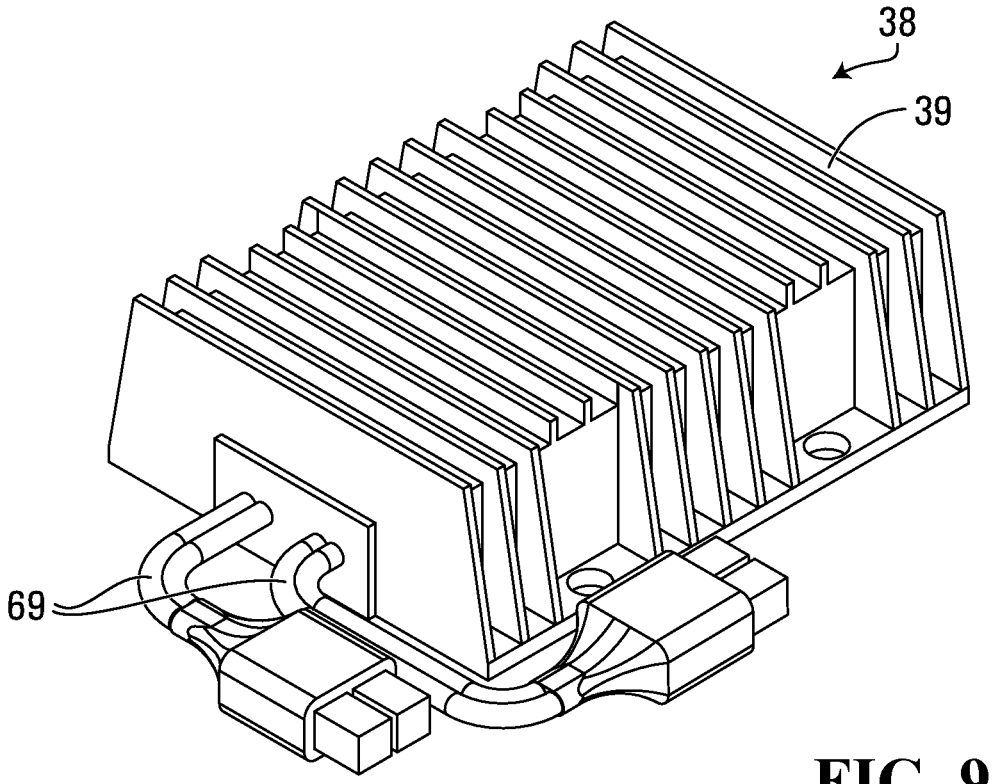
FIG. 9 is a perspective view of a power converter of the controller of FIG. 5.
Figure 10:
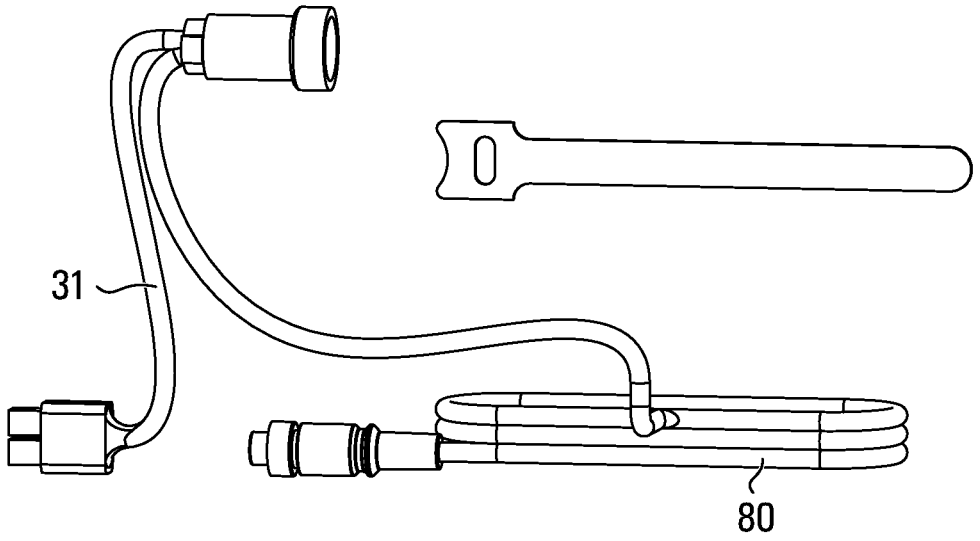
FIG. 10 shows wires and connectors of the controller of FIG. 5.

In the drawings, embodiments are illustrated by way of example. It is to be expressly understood that the description and drawings are only for purposes of illustrating certain embodiments and are an aid for understanding. They are not intended to be a definition of the limits of the invention.

DETAILED DESCRIPTION OF EMBODIMENTS

A detailed description of one or more specific embodiments of the invention is provided below along with accompanying Figures that illustrate principles of the invention. The invention is described in connection with such embodiments, but the invention is not limited to any specific embodiment. In particular, the present detailed description presents, amongst other, some embodiments in which the frame of the scanner has a substantially triangular outer periphery and has an inner periphery defining a substantially triangular opening wherein respective handle regions are provided around the substantially triangular opening on each of the three sides of the substantially triangular inner opening. It is to be appreciated that the embodiments described are being provided only for the purpose of illustrating the inventive principles and should not be considered as limiting. In particular, alternate embodiments will become apparent to the person skilled in the art in view of the present description, for example embodiments in which the outer periphery and/or inner periphery have a generally polygonal shape other than a generally triangular shape or a shape in which at least some of the portions are curved (rather than elongated such as, for example, a crescent shape or a half moon shape); in which the opening is partially (rather than fully) enclosed by the frame; in which there is no opening as well as other suitable alternate constructions. The scope of the invention is limited only by the claims. Numerous specific details are set forth in the following description in order to provide a thorough understanding of the invention. These details are provided for the purpose of describing non-limiting examples and the invention may be practiced according to the claims without some or all of these specific details. For the purpose of clarity, technical material that is known in the technical fields related to the invention has not been described in great detail so that the invention is not unnecessarily obscured.

FIGS. 1 to 4 show a scaffold assembly 2 comprising a mobile scaffold 10 and a scaffold motorization system 20 installed on the mobile scaffold 10. The mobile scaffold 10 has a forward direction, a rear direction, a left direction and a right direction. The scaffold 10 comprises one or more platforms 16 and a set of legs 12 supporting the one or more platforms 16. More specifically, in this embodiment, the legs 12 comprise left and right front legs and left and right rear legs. The scaffold 10 may comprise casters 14 and a guard rail 18. At least some of the legs 12 may be counted on the casters 14. For instance, in this case, each leg 12 is mounted on a caster 14. The legs 12, casters 14, one or more platforms 16 and guard rail 18 may have any suitable shape and dimensions. For instance, in some embodiments, the guard rail 18 may be cylindrical and may have a diameter of 1 inch or 1.5 inch, and the legs 12 may have a square cross-section and may have a side of 1 inch or 1.5 inch. The scaffold 10 may comprise any suitable material, including, for example, metals (steel, iron, aluminum, etc.), wood, polymeric materials, etc.

In this embodiment, the scaffold motorization system 20 comprises a set of wheel assemblies 40 to be releasably mounted to at least some legs 12 of the scaffold and configured to impart or prevent motion to the scaffold 10, and a controller 30 in communication with the set of wheel assemblies for controlling motion to the scaffold 10 at least in part in response to control signals received from a control device 50 operated by a person. For instance, the set of wheel assemblies 40 may include a set of wheels 46 and at least one motor 44 configured to drive at least some of the wheels 46 in a forward direction and a backward direction; the controller 30 may be for controlling the at least one motor 44 to drive at least some of the wheels 46; and in response to control signals conveying specific commands 54 received from the control device 50, the controller 30 may be configured to transform the specific commands 54 into corresponding electric signals to power the at least one motor 44 to drive the at least some of the wheels 46 in at least one of the forward direction and the backward direction.

As further discussed below, the scaffold motorization system 20 may be advantageously removable from the scaffold 10, light, easy to transport, quick to install and dismount, and may provide improved manoeuvrability and safety when installed on the scaffold 10.

As shown in FIGS. 5 to 10, the controller 30 may comprise a casing 32 and a processing system 110 configured to receive and process one or more command signals (e.g., which may be representative of a user input) and to generate electric signals based on the command signals to control the wheel assemblies 40 and to move the scaffold assembly 2. The controller 30 may also comprise sockets 36 for connecting the controller 30 to other components of the scaffold motorization system 30, such as the wheel assemblies 40. Optionally, the controller 30 may also comprise a power converter 38.

In this embodiment, the casing 32 of the controller 30 is configured to impart structural integrity of the controller 30 by providing stiffness and allowing attachment of the other components of the controller 30 and/or of the scaffold motorization system 20. In this case, when installed on the scaffold 10, the casing 32 may define an internal volume housing the processing system 110 and the power converter 38, and optionally other accessories (such as power cables, the power adapters 96, communication wires, the control device 50, etc.).

In this embodiment, the processing system 110 may be located in the internal volume of the casing 32. Such a processing system 110 typically includes a processing unit 112 (which may include one or more processors) and a memory 114 that is connected to the processing unit 112 by a communication bus 118. The memory 114 may be any suitable memory and may include read-only memory (ROM) and/or random access memory (RAM and/or an external memory device). The memory 114 includes program instructions 116 and data 120. The processing unit 112 is adapted to process the data 120 and the program instructions 116 in order to implement at least some of the functionality related to the scaffold motorization system 20 including processes for receiving and analyzing a command from a controller and generating electric signals based on the command. The processing system 110 may also comprise one or more I/O interfaces 111 for receiving or sending data elements to various modules external and internal to the scaffold motorization system 20. For instance, in this embodiment the processing system 110 may be connected to other components of the controller 30 (e.g., the sockets 36, the power converter 38, the connector 92, etc.) by data/power cables 31.

In this example, the processing system 110 may be attached to the casing 32 of the controller 30. The processing system 110 may be attached to the casing 32 in any suitable way. In this case, the processing system 110 may be fastened to the casing 32 be being screwed to the casing 32.

In this embodiment, the controller 30 is in communication with the wheel assemblies 40 when the scaffold motorization system 10 is installed on the scaffold 10. To this end, one or more sockets 36 may be provided an accessible part the controller to facilitate connection of at least some of the components of the controller 30 (e.g., the processing system 110, the cables 31) to the wheel assemblies 40 (e.g., the motors 44, the brakes 70).

The power converter 38 is configured to convert electric energy received from the power source 90 from one form to another that is adapted for powering the processing system 110, such as by changing the current type, the voltage or frequency of the current or do some combination of these. For instance, in this embodiment, the power converter 38 may be connected to the power source 90 via the connector 92, and may be further connected to the processing system 110 by power cables 69.

The power converter 38 may comprise a heat sink 39 configured to dissipate heat generated by the power converter 34. The heat sink 39 may include a plurality of fins arranged to establish a thermal coupling between the power converter 34 and surrounding fluid (e.g. air).

In this example, the power converter 38 may be attached to the casing 32 of the controller 30. The power converter 38 may be attached to the casing 32 in any suitable way. In this case, the power converter 38 may be fastened to the casing 32 be being screwed to the casing 32.

In some embodiments, the power converter 38 may not be required and therefore the system 20 may be free of a power converter. In some embodiments, the power converter may be integrated into the processing system 110.

In this embodiment, the controller 30 may further comprise an on/off switch 98 to turn the controller 30 on/off, respectively.

As shown in FIGS. 11 to 21, in this embodiment, the set of wheel assemblies 40 may include at least two wheel assemblies. Each of the wheel assemblies may comprise a frame 42 for being mounted to one of the legs 12 of the scaffold 10, a motor 44 mounted to the frame 42, and a wheel 46 controllably driven by the motor 44 in a forward direction and a backward direction.

Each of the wheel assemblies 40 may be connected to the controller 30. More specifically, in this embodiment, each of the wheel assemblies 40 is connected to the controller 30 so that the wheel assemblies 40 and the controller 30 are in communication and can exchange signals (e.g., via a wire or wireless connection). For instance, each of the wheel assemblies 40 may comprises a wire 41 connecting the motor 44 and the brake 70 to one of the sockets 36 of the controller 30 to hold the controller 30 into place.

Figure 11:
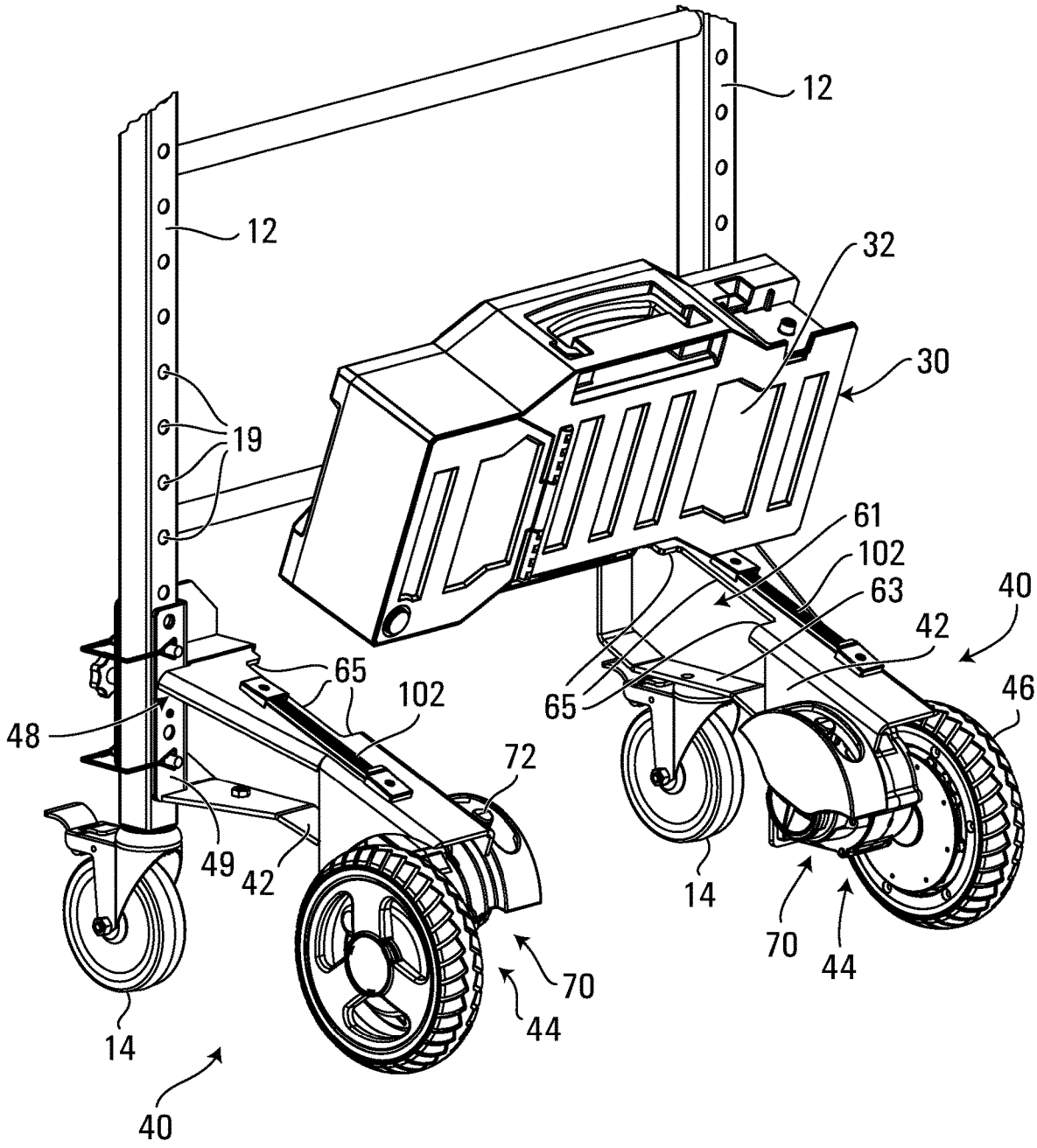
FIGS. 11 and 12 show an installation process of the controller of FIG. 5 on the mobile scaffold and on wheel assemblies of the scaffold motorization system.
Figure 12:
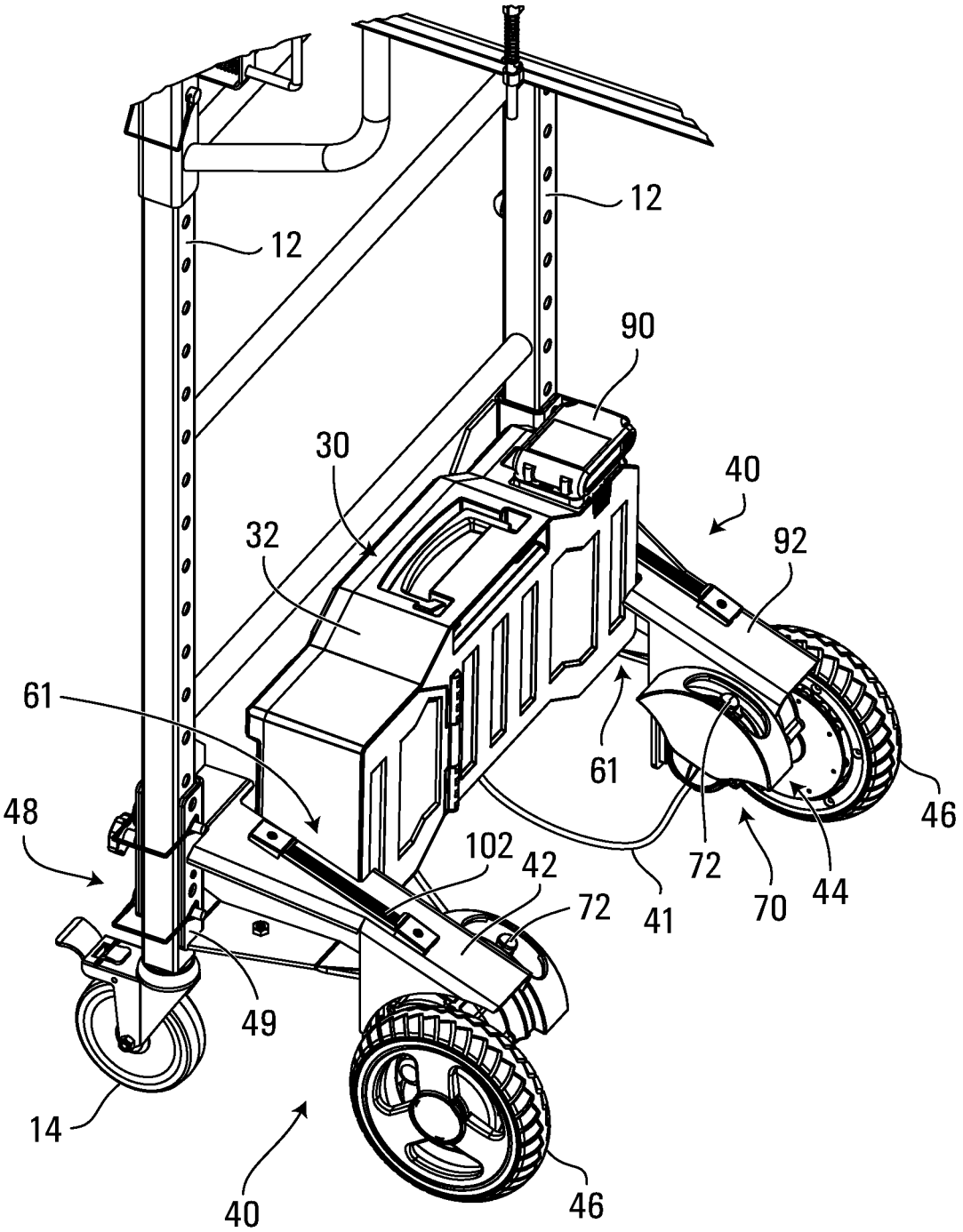
Figure 13:
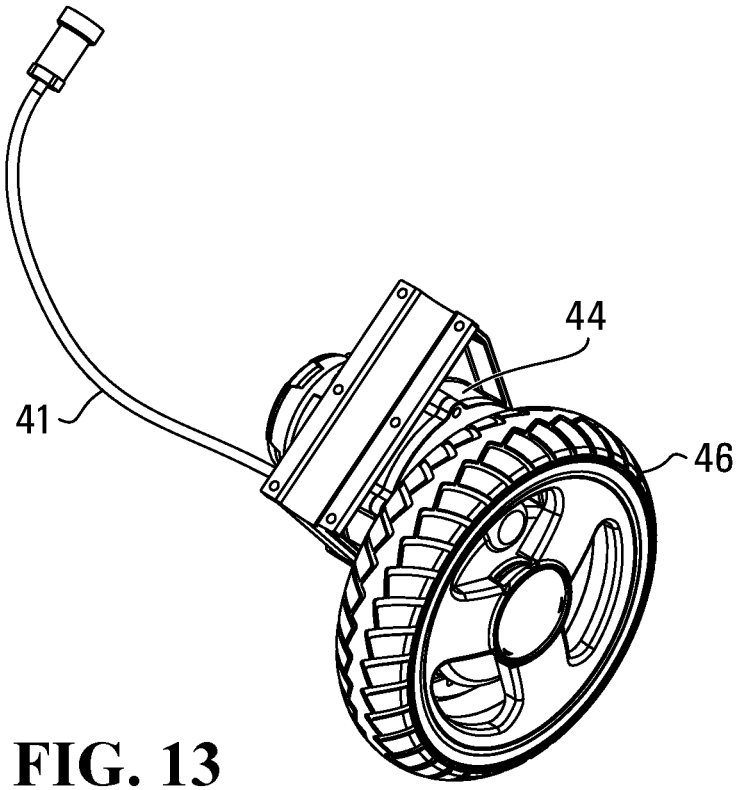
FIGS. 13 and 14 show left and right wheels of the scaffold motorization system of FIG. 1.
Figure 14:
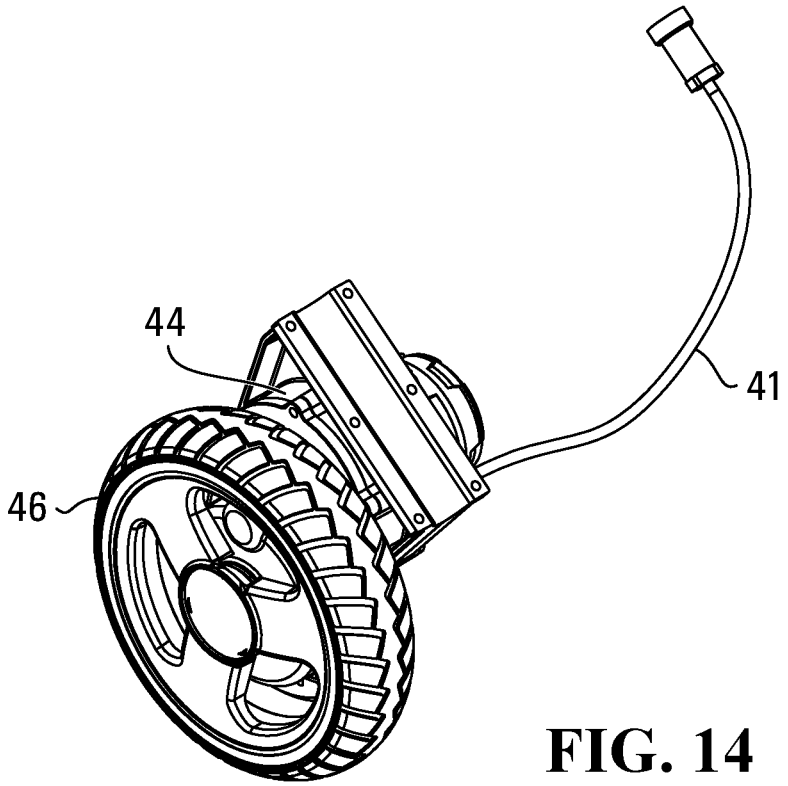

With additional reference to FIGS. 11 and 12, in this embodiment, each wheel assembly 40 may at least partly hold the controller 30 in place during use. In particular, the wheel assemblies 40 may define a receiving room 61 to insert the side extremities of the controller 30 until side portions of the bottom of the casing 32 engage the wheel assemblies 30, thereby having the controller 30 being supported by the wheel assemblies 40 while bridging the wheel assemblies 40. More specifically, the controller 30 may be configured to be rest on surfaces 63 of the frame 42 of the wheel assemblies 40 and may be held into place laterally and longitudinally by surfaces or edges 65 of the of the frame 42 of the wheel assemblies 40 defining the receiving room 61.

The frame 42 of each wheel assembly 40 is configured to impart structural integrity of the wheel assembly 40 by providing stiffness and allowing attachment of the other components of the wheel assembly 40 and/or of the scaffold motorization system 20. In particular, the frame 42 of each wheel assembly 40 may comprise a connector 48 for mounting the frame 42 to the leg 12 of the scaffold 10.

Figure 15:
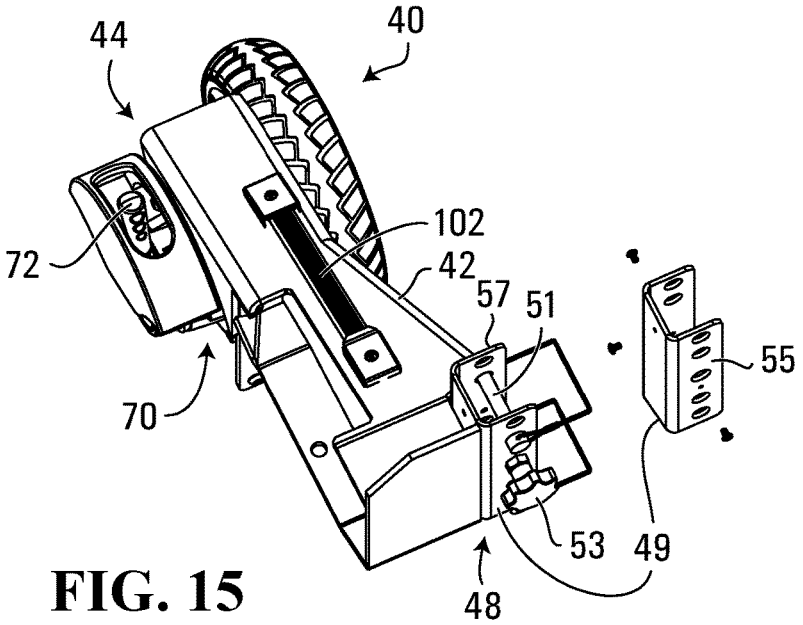
FIGS. 15 and 16 show different configurations of a wheel assembly of the scaffold motorization system of FIG. 1, including the wheel of FIG. 13.
Figure 16:
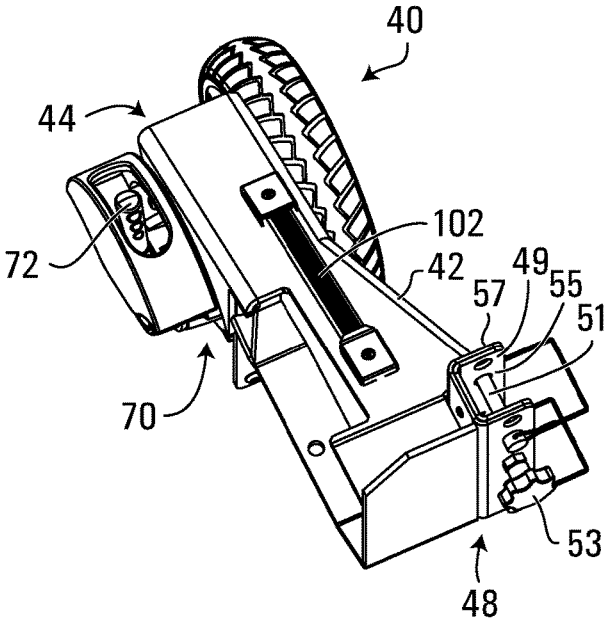
Figure 17:
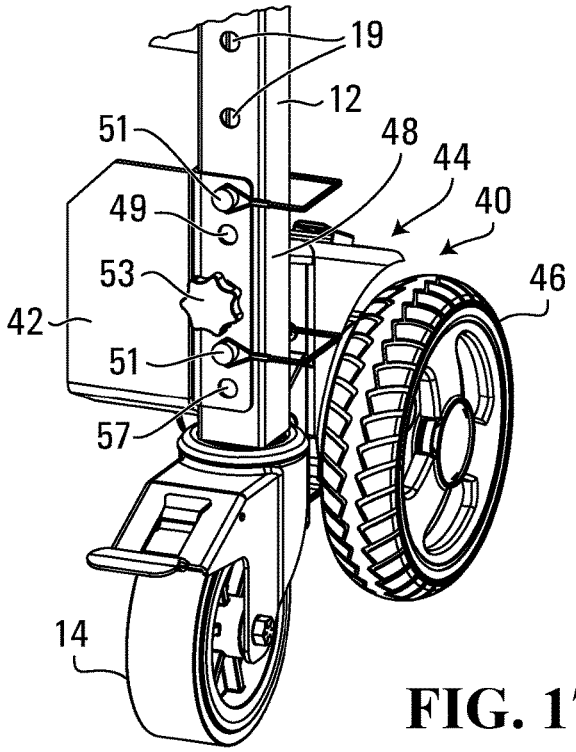
FIG. 17 shows an enlargement of the wheel assembly of FIGS. 15 and 16 installed on a leg of the mobile scaffold.
Figure 18:
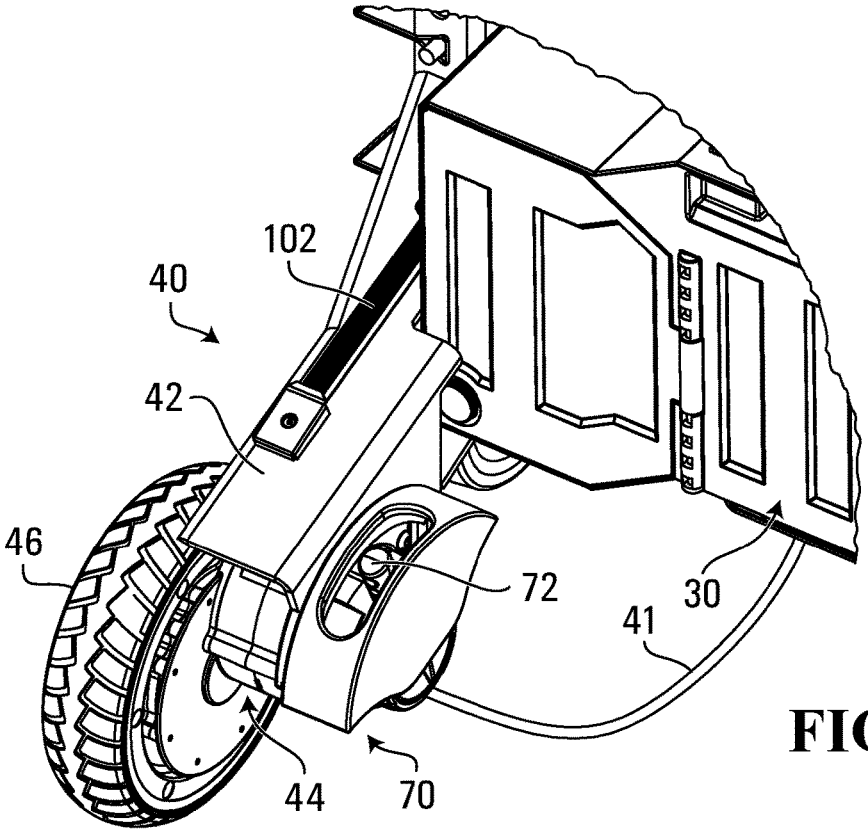
FIG. 18 shows an enlargement view of a portion of the scaffold assembly of FIG. 1.

With additional reference to FIGS. 15 to 17, in this embodiment, the connector 48 of the frame 42 may comprises a member 49 configured to surround at least part of the leg 12 of the scaffold 10. The member 49 may comprise a U-channel member 57. The U-Channel member 57 may be configured to allow attachment to different sizes and shapes of scaffold legs, thus allowing the scaffold motorization system 10 to be adaptable for different scaffold models. To this end, a set of U-Channel adapters 55 removably attachable to the U-Channel member 57 (e.g., by being screwed or otherwise fastened thereto) may be provided to ensure that inner dimensions of the member 49 correspond to outer dimensions of the leg 12.

The leg 12 of the scaffold 10 may comprise a plurality of apertures 19 disposed vertically. The U-Channel member 57 and the U-Channel adapters 55 may feature openings adapted to be aligned with apertures 19 of the leg 12. The connector 48 of the frame 42 may comprises pins 51 insertable into openings of the member 49 and a given one of the apertures 19 to attach the member 49 to the leg 12 of the scaffold 10. When mounting a U-channel member to a leg 12, the pins are inserted in the openings, securing the U-channel member around the leg 12. A manually operable screw 53 insertable into one of the apertures of the member 49 may also be used to abut against the leg 12 to prevent the wheel assembly 40, once mounted, to budge relatively to the leg 12.

The frame 42 may be made in any suitable way and may comprise any suitable material, including a rigid material, including magnetic and non-magnetic metals such as steel, aluminum, etc., and including other materials such as polymeric materials, composite materials, and so on.

In this embodiment, the set of wheel assemblies 40 may include two or more motors 44, and each motor 44 may be connected to a respective wheel assembly 40. The motors 44 are configured to drive the wheels 46, thus driving the scaffold assembly 2. The motors 44 may be any suitable kind of motor. For instance, the motors 44 may be electric wheel hub motors respectively incorporated into hubs of the wheels 46.

In this embodiment, each wheel assembly 40 may be configured to be installed on a front one of the legs 12, and each wheel 46 is configured to be installed rearwards to a front one of the casters 14 of the scaffold 10. The wheels 46 may be configured to be spaced apart by a span S that is no longer than a width W of the scaffold when the scaffold motorization system 20 is installed on the scaffold 10. In other words, installing the scaffold motorization system 20 on the scaffold 10 does not increase the dimensions (width, length, and height) of the scaffold 10 and therefore allows the scaffold assembly 2 can be used in the same restrained spaces (e.g., door frames) than the scaffold 10 without the scaffold motorization system 20.

In this embodiment, the wheels 46 may be restrained from being steered, i.e., rotating out of their rotation axis. In other words, the position of each wheel assembly relative to the controller 30 may remain generally the same. Yet, the scaffold motorization system 20 may be capable to rotate the scaffold 10 when the wheels 46 are restrained from being steered. This may be achieved in any suitable way, e.g., by powering the wheels 36 at different speeds and/or in opposite directions.

The wheels 46 may be of any suitable type and dimensions. For instance, in some embodiments, the wheels 46 may comprise pneumatic tires, while in other embodiments, non-pneumatic tires (NPT) may be used. In some embodiments, the wheels 46 may have a diameter of at least 6 inches, in some embodiments of at least 9 inches, in some embodiments of at least 12 inches, and in some embodiments of even more.

Figure 21:
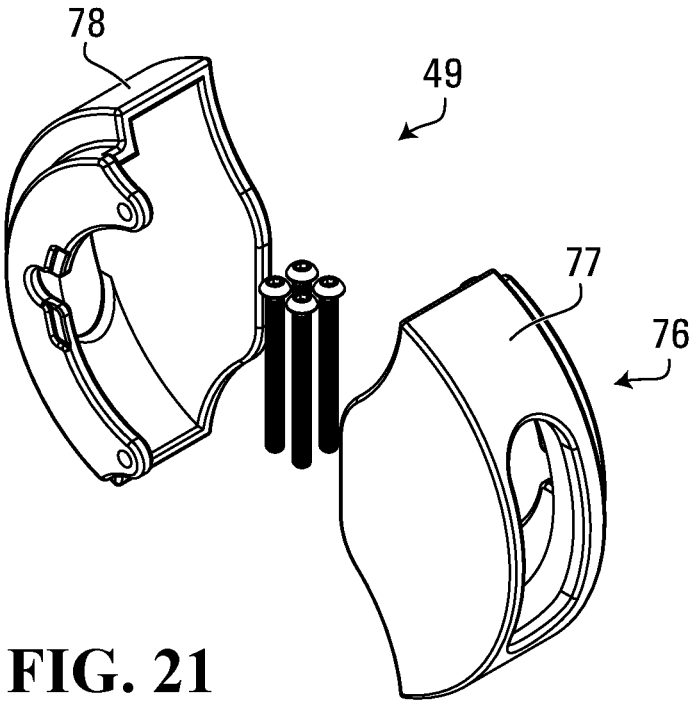
FIG. 21 shows an embodiment of a wheel protector for use in connection with the scaffold motorization system of FIG. 1.
Figure 22:
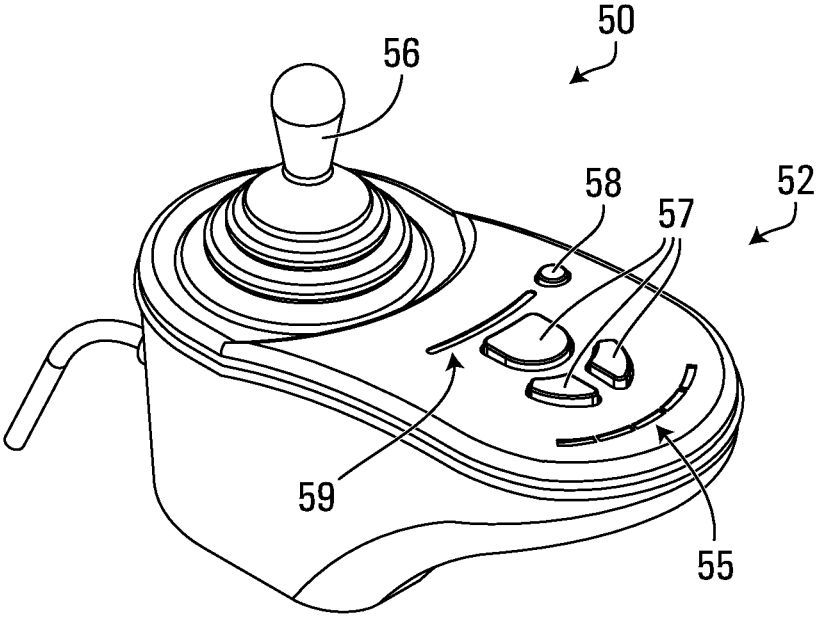
FIG. 22 shows an embodiment of a control device for use in connection with the scaffold motorization system of FIG. 1.

In some embodiments, as shown in FIG. 21, each wheel assembly 40 may comprise a wheel protector 49 for protecting the wheel 46 against impacts. The wheel protector 49 may have any suitable shape and dimension. For instance, in this example, the wheel protector 49 comprises a shell 76 configured to surround at least partly the wheel 46. The shell 76 may comprise a first part 77 and a second part 78. Each of the parts 77, 78 may be attached to one another and to the frame 42 in any suitable way. More specifically, in this embodiment, the parts 77, 78 may be fastened to the frame 42 be being screwed to the frame 42.

In this embodiment, as shown in FIGS. 22 to 27, the control device 50 may be configured to generate command signals conveying specific commands 54. The control device 50 may comprise and/or implement a user interface 50 to interact with a person operating the scaffold motorization system 20, such as by receiving user inputs from the person. The specific commands 54 of the control device 50 may be at least partly based on user input received at the user interface 52.

The control device 50 may be of any suitable kind. For instance, in some embodiment, the control device 50 is a manually operable and may comprise one or more of a joystick 56, a button 57 (e.g., a powering button used to power up and shut down the scaffold motorization system 20; a horn button use to emit a sound signal; an accelerate button to increase speed of the scaffold 10; a deceleration button to decrease speed of the scaffold 10, etc.), an on/off switch 58, a display, a light indicator 55 (e.g., a power indicator turned off when the scaffold motorization system 20 is turned off, and turned on when the scaffold motorization system 20 is powered and ready to be operated; a speed indicator adapted to provide an indication of the set speed, etc.) and so on. In some cases, the control device 50 may comprise a speaker 59. More specifically, the speaker 59 may be a horn configured to generate noise whenever the scaffold motorization system 20 is driving the scaffold 10 and/or whenever a user input is detected.

Figure 23:
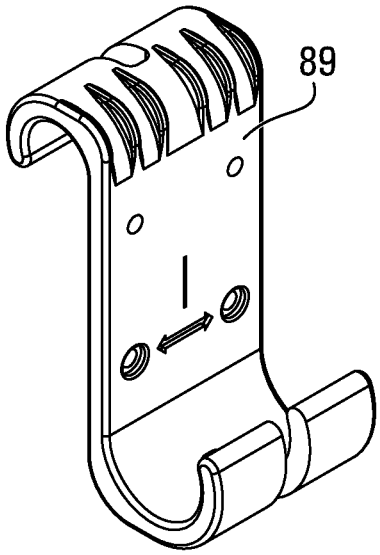
FIG. 23 shows an embodiment of a connector to mount the control device of FIG. 22 on a railing portion of the scaffold.
Figure 25:
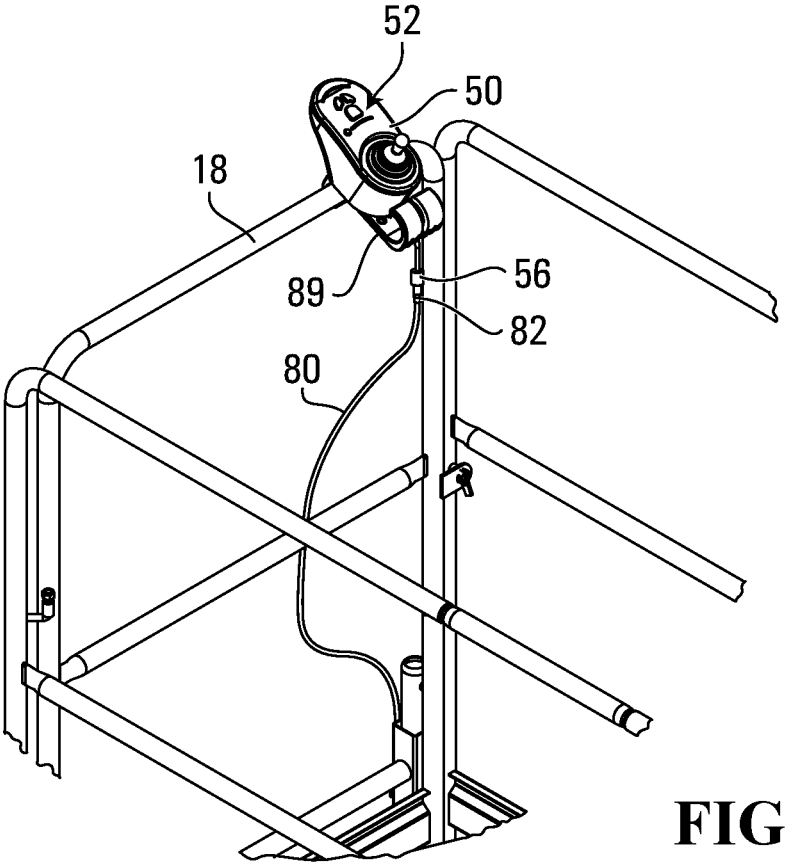
FIG. 25 shows the control device of FIG. 22 mounted on the railing portion of the scaffold using the connector of FIG. 23.

In this example, with additional reference to FIGS. 23 and 25, the control device 50 may be attached to a connector 89 attachable to the scaffold railing 18. The connector 89 may be attached to the control device 50 in any suitable way. In this case, the connector 89 is removably attached to the control device 50. More specifically, in this embodiment, each connector 89 may be fastened to the control device 50 be being screwed to the control device 50. The connector 89 may also be attachable to the scaffold railing 18 in any suitable way. In this embodiment, the connector 89 comprises a cylindrical section configured to clip over a portion of the railing 18. As such, in some embodiments, the control device 50 may be part of the scaffold motorization system 20.

Figure 26:
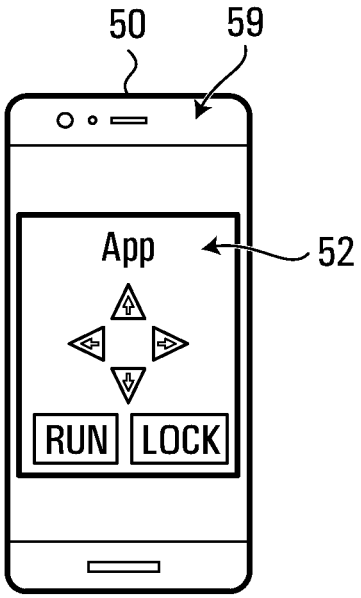
FIG. 26 shows another embodiment of a control device.
Figure 27:
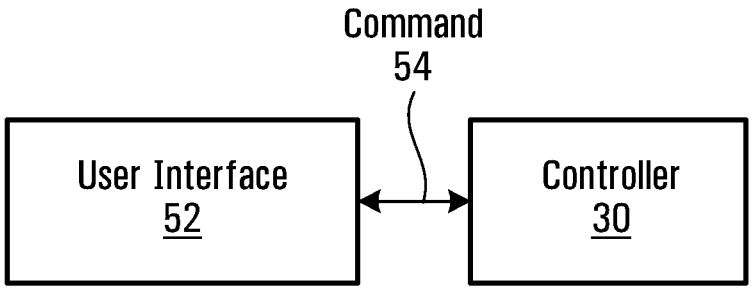
FIG. 27 is a block diagram of a user interface interacting with the controller of FIG. 5.

In some embodiments, as shown in FIG. 26, the control device 50 may be any computing device such as, for example, one of: a computer, a smartphone, a laptop, a tablet computer and a phablet, on which program instructions are executed, and comprising a display. In this example, the user interface 52 may be a graphical user interface accessible through one of: an app, a webpage, and a software. As such, in some embodiments, the control device 50 may be remote from of the scaffold motorization system 20 and from the mobile scaffold 10. In some specific implementations, the software code may be accessible over a computer network and downloaded onto the computer device (e.g. onto a smartphone). In such cases, suitable hardware may be provided in the controller for allowing the controller to establish a communication link with computing device, for example over a Bluetooth link, IR link or other suitable wireless link.

In particular, instead of being included as part of the scaffold motorization system 20, the control device 50 may be included within a remote computing device that is in wireless connection with the controller 30, either directly or via a network connection. The remote computing device could be in RF or infrared communication with the controller 30, or more likely, the remote computing device will be in communication with the controller 30 via a network connection. The network connection can be any type of connection, such as a WiFi connection, zigbee connection, home network connection, Internet connection, wimax connection and plc (power line communication).

The remote computing device may a user control interface for displaying to a user a graphical user interface, may be any type of computing device known in the art. For example, the remote computing device may be a personal computer such as a desktop or laptop computer, or a portable handheld computing device, such as a PDA, a cell phone, a smart phone (such as a BlackBerry™ or an iPhone™), or a web-enabled computing device, such as an iTouch™, iPad™ or computer tablet, among other possibilities. The drawings included within the present document show the graphical user interface as being displayed on a remote computing device that is in the form of a smartphone. However, the invention is certainly not limited to this implementation.

The control device 50 may be connectable to the controller 30 in any suitable way. For instance, in some embodiments, the control device 50 is connectable to the controller 30 via a wire connection. More specifically, the control device 50 may comprise an I/O interface 56 configured to receive a first connector 82 of a wire 80 and the controller 30 may comprise an I/O interface 66 configured to receive a second connector 84 of the wire 84.

Figure 24:
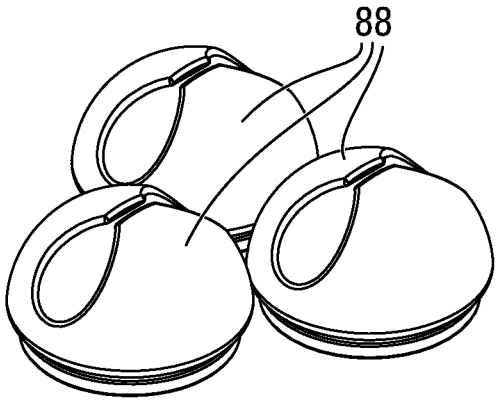
FIG. 24 shows an embodiments of magnet clips to orient a wire connecting the control device of FIG. 22 to the controller of FIG. 5.

With additional reference to FIG. 24, in some embodiments, magnets 88 may be attached to the wire 80 to allow the operator to dispose and orient the wire 80 to avoid nuisance and safety hazards during operations. Each magnet 88 may be provided on a clip or fastener removably attachable to a selected location of the wire 80. Parts of the scaffold 10 may be made of a magnetic material, the magnets 88 may be used to removably attach the selected locations of the wire 80 to selected parts of the scaffold 10.

In some embodiments, the control device 50 may be connectable to the controller 30 wirelessly (e.g., using a WiFi connection, a Bluetooth connection, 4G, 5G, an IoT, a UPnP protocol, etc.). In such cases, the controller 30 may include suitable hardware/software in order to establish such communication link.

Upon the controller 30 be connected to a power source 90, the controller 30 may configured to receive the specific commands 54 of the control device 50 and to generate distinct electric signals 62 based on the specific commands 54 powering each of the motors 44 in one of the forward direction and the backward direction. More specifically, in this embodiment, the controller 30 is configured to transform the specific commands 54 into the electric signals 62 independently powering each of the motors 44 in one of the forward direction and the backward direction.

For instance, the specific commands 54 may comprise a linear movement command such as a forward movement command. In response to the forward movement command, the electric signals 62 may cause each of the motors 44 to be powered in the forward direction. The specific commands 54 may also comprise a rear movement command, and in response to the rear movement command, the electric signals 62 may cause each of the motors 44 to be powered in the rear direction.

The specific commands 54 may comprise a rotation command such as a clockwise or counterclockwise rotation command. In response to the rotation command, the electric signals 62 may cause each of the motors 44 to be powered into motion at different speeds and/or different directions. For instance, in some examples, the electric signals 62 may cause each of the motors 44 to be powered into motion at the same speed but at opposite directions, thus rotating the scaffold 10 and the scaffold motorization system 20 around a pivot point located between the wheels 46.

In this embodiment, the scaffold motorization system 20 may be capable to rotate to the scaffold 10 at tight angles. For instance, in some embodiments, the scaffold motorization system 20 may impart a rotation motion to the scaffold 10 having a radius of less than 1 m, in some embodiments of less than 0.5 m, and in some embodiments of less than 0.3 m.

In some embodiments, the specific commands 54 may comprise a combination of a linear motion command and a rotation command. In response to such combined command, the electric signals 62 may cause each of the motors 44 to be powered into motion at different speeds so that the scaffold motorization system 20 moves the scaffold 10 linearly and in rotation simultaneously.

The motors 44 may be configured to move the scaffold 10 at any suitable speed. For instance, in some embodiments, a maximum forward speed of the scaffold motorization system is at least 1 km/h, in some embodiments at least 3 km/h, at least 5 km/h, and in some embodiments even more, and a maximum rear speed of the scaffold motorization system is at least 1 km/h, in some embodiments at least 3 km/h, at least 5 km/h, and in some embodiments at even higher speeds. The motors 44 may also be configured to rotate the scaffold at any suitable speed. For instance, in some embodiments, a rotation speed of the scaffold motorization system is at least 0.3 rad/s, in some embodiments at least 0.5 rad/s, at least 0.7 rad/s, and in some embodiments at even higher speeds.

In some embodiments, the linear and rotational speed of the motors 44 may be adjusted and/or variable. For instance, in some embodiments, the user interface 52 may comprise a setting to define a maximal speed of the wheels 46. In some embodiments, the specific commands 54 may comprise an intensity component and the controller 30 may be configured to translate the intensity component into electric signals 62 indicative of a speed to the motors 44. In some examples, the user interface 52 may be configured to allow the user to select one of a plurality of speed settings (for example via the buttons 57), and the intensity component of the command 54 may be representative of the selected speed setting. For instance, the plurality of speed settings may comprise at least two (2) speed settings, in some embodiments at least three (3) speed settings, in some embodiments at least four (4) speed settings, in some embodiments at least five (5) speed settings, and in some embodiments even more. In some alternative embodiments the speed setting may be able to implement a continuously variable speed wherein an essentially infinite number of actual speeds may be achieved between a rest status and a maximum speed. In some examples, when the operator applies light pressure on a specific button, the intensity component of the command 54 may be representative of a light pressure and the electric signals 62 generated by the controller 30 may cause the motors 44 to move at low speeds, and when the operator applies high pressure on the specific button, the intensity component of the specific commands 54 may be representative of a high pressure and the electric signals 62 generated by the controller 30 may cause the motors 44 to move at high speeds.

In this embodiment, each of the wheel assemblies 40 comprises a brake 70 affixed to the structure 32 and configured to prevent motion of the wheel 46 upon actuation. For instance, the brake 70 may be an electromagnetic brake. The brake 70 may be configured to be actuated when no signal is transmitted to the brake 70 such that the brake 70 is actuated at rest and prevents the wheels 46 from moving.

Figure 28:
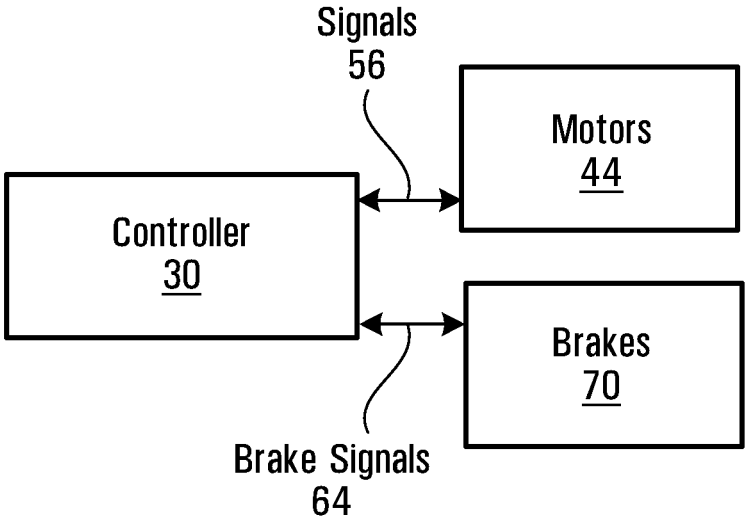
FIGS. 28 and 29 are block diagrams of the controller of FIG. 5 interacting with components of wheel assemblies.

As shown in FIG. 28, the brakes 70 may be in communication with the controller 30. In particular, in this embodiment, the controller 30 may be configured to generate movement signals 64 based on the command 54 of the control device 50, and the brakes 70 may be configured to disengage in response to receiving the movement signals 64 to allow movement of the wheels 46.

Figure 19:
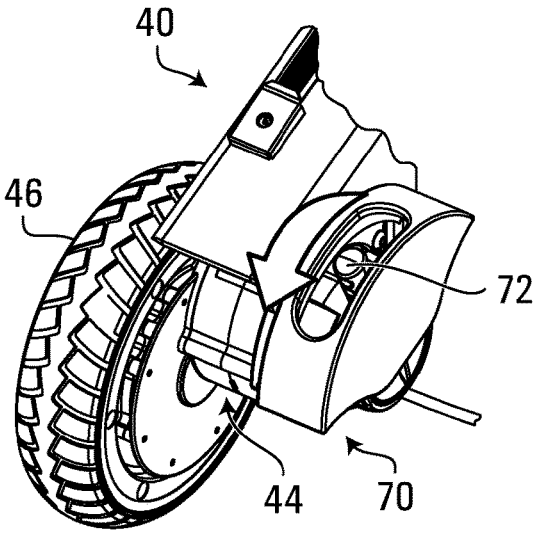
FIGS. 19 and 20 illustrate a locking system of the wheel assembly of FIGS. 15 and 16.
Figure 20:
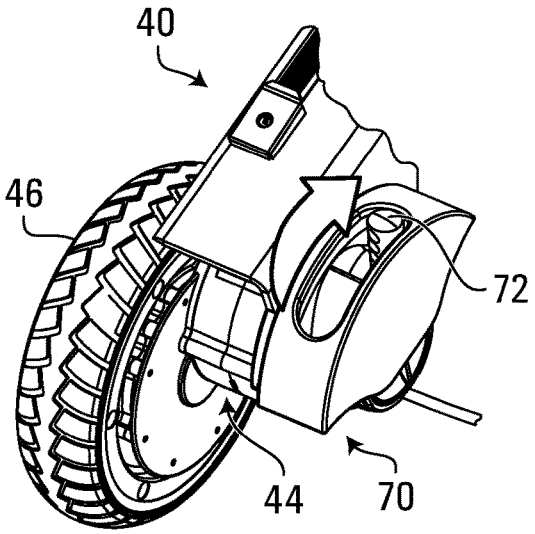

As shown in FIGS. 19 and 20, in some embodiments, each of the wheel assemblies 30 may comprise a locking system 72 manually operable to disconnect the brake 70 to the wheel 46, e.g., so that the operator can move the scaffold 10 (e.g., by pushing or pulling the scaffold 10) when the locking system 72 is disengaged.

The power source 90 may be any suitable power source 90. For instance, in the embodiments shown in the figures, the power source 90 is a battery. More specifically, the battery 90 is a power tool battery. The battery 90 may have any suitable voltage, and in this example, the battery 90 has a voltage between 13V and 40V, and in some embodiments more specifically 16V and 22V. Alternative power sources may be used in alternate implementations, including for example, but without being limited to, a connection to a suitable electrical power outlet.

Figure 30:
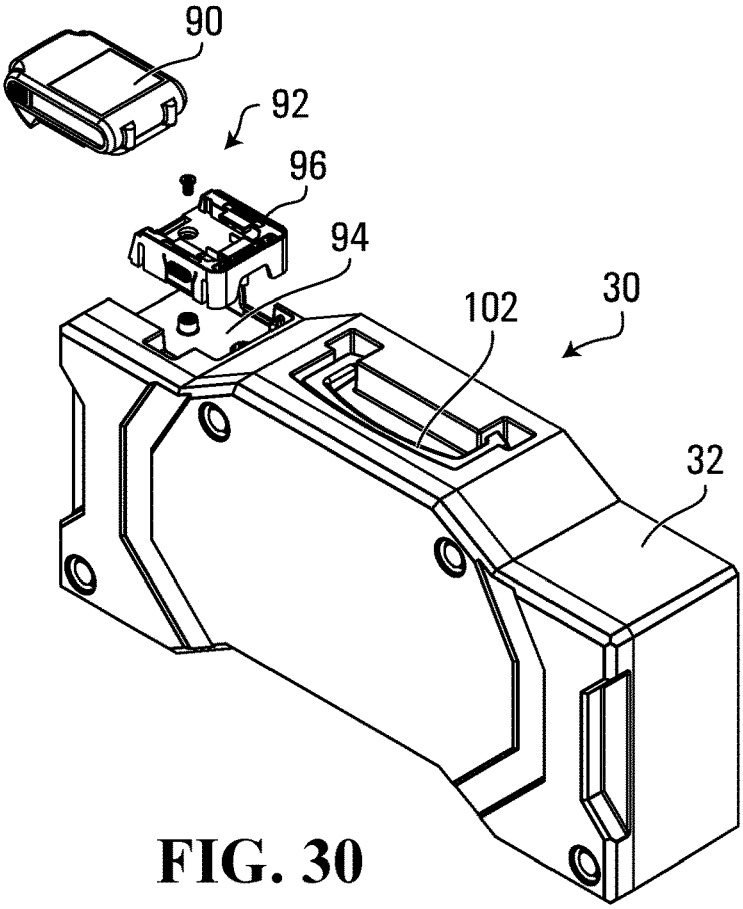
FIGS. 30 and 31 are an exploded view and a perspective view of a connector connecting a power source to the controller of FIG. 5.
Figure 31:
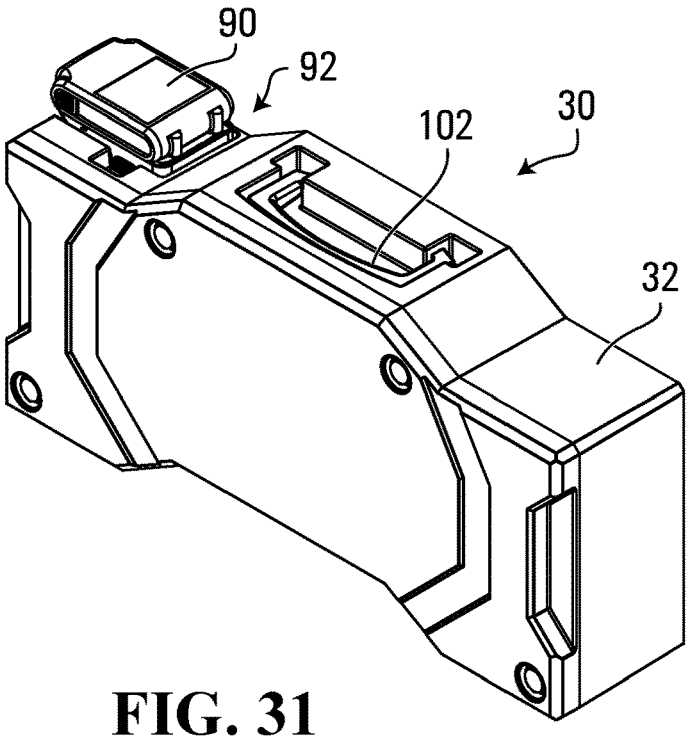
Figure 32:
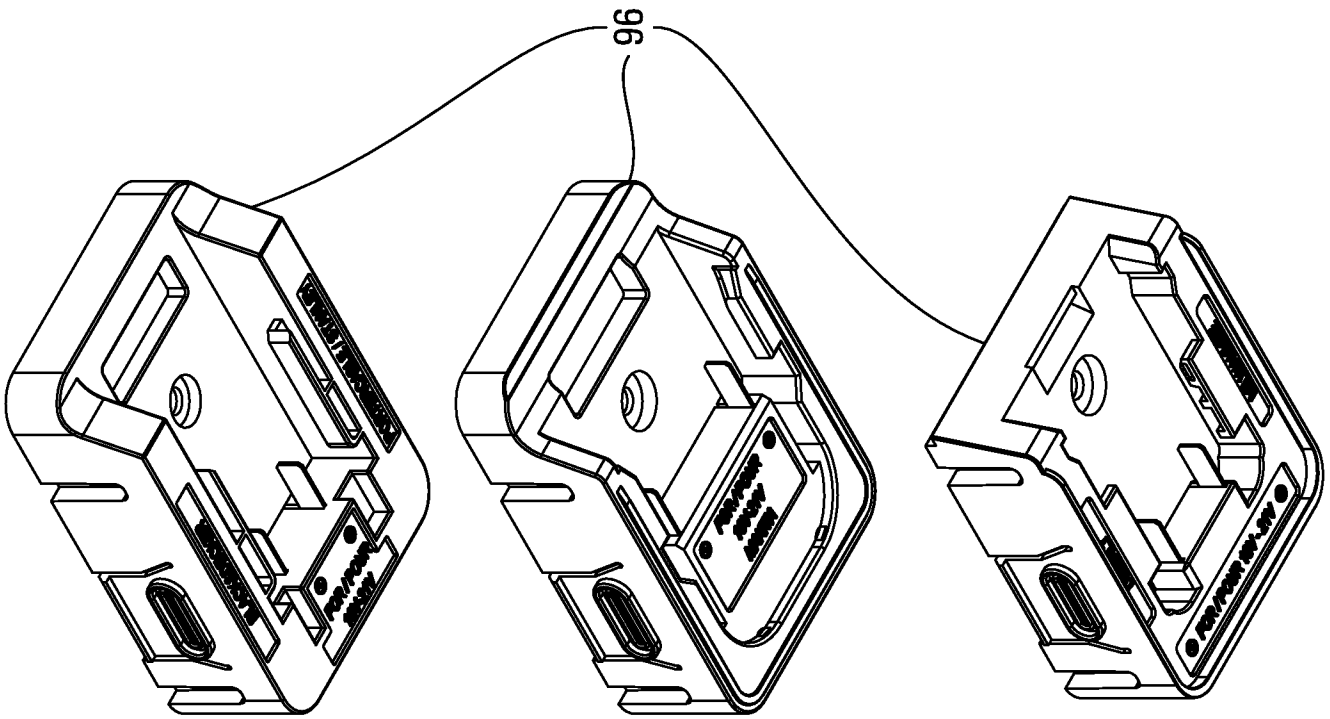
FIG. 32 shows a set of different power adapters for use in connection with the scaffold motorization system of FIG. 1.
Figure 33:
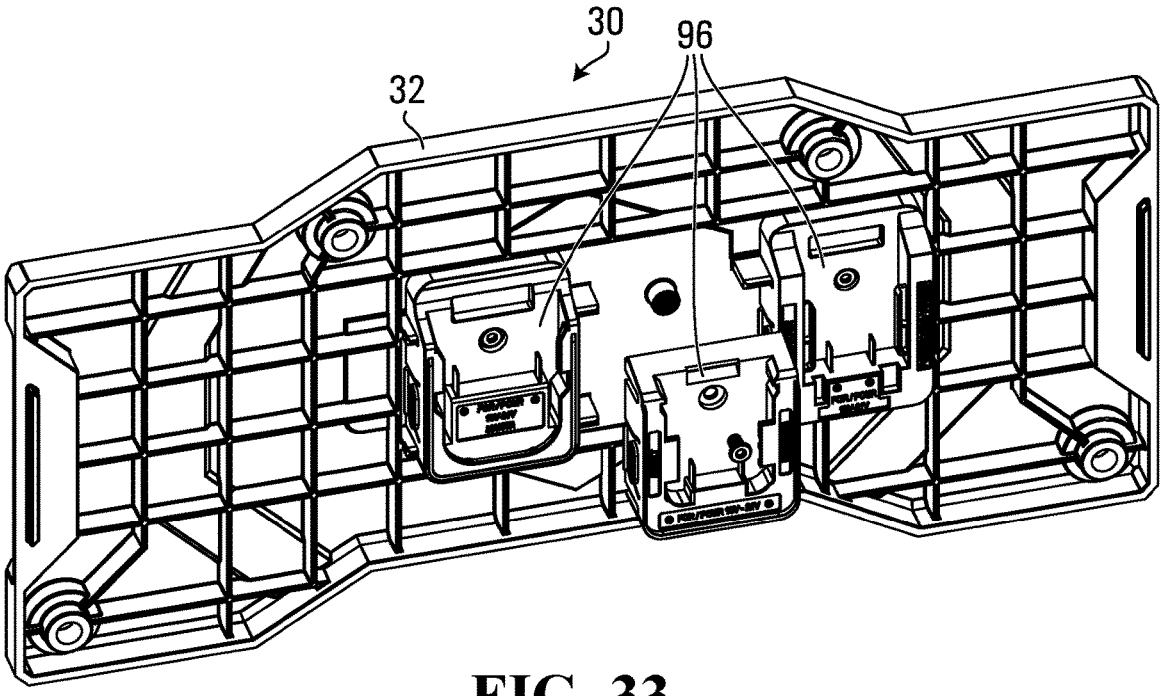
FIG. 33 shows a portion of an internal storage space of a casing of the controller configured to store the power adapters of FIG. 32.
Figure 34:
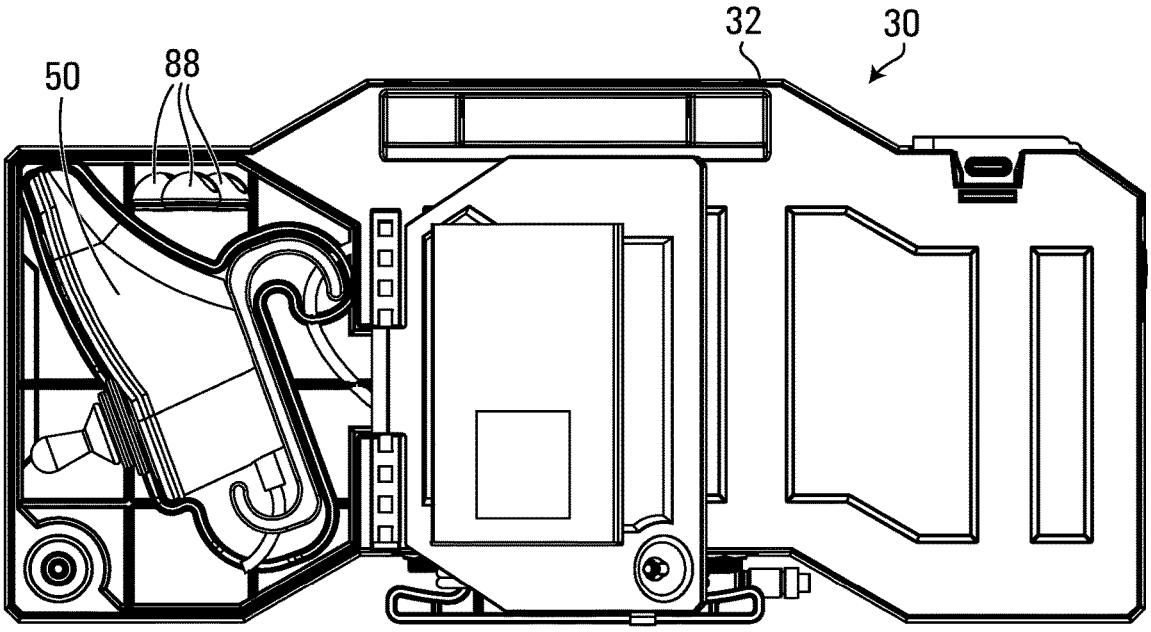
FIG. 34 shows another portion of the internal storage space of FIG. 33 configured to store a control device and other accessories.
Figure 35:
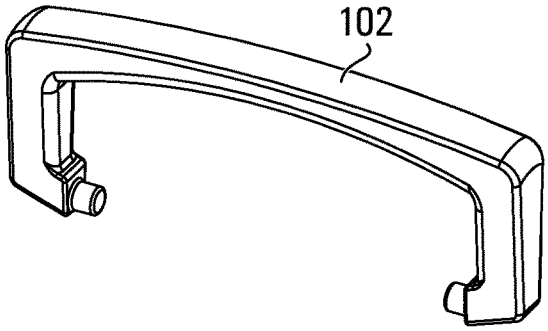
FIG. 35 shows a handle for transportation of the scaffold motorization system of FIG. 1.
Figure 36:
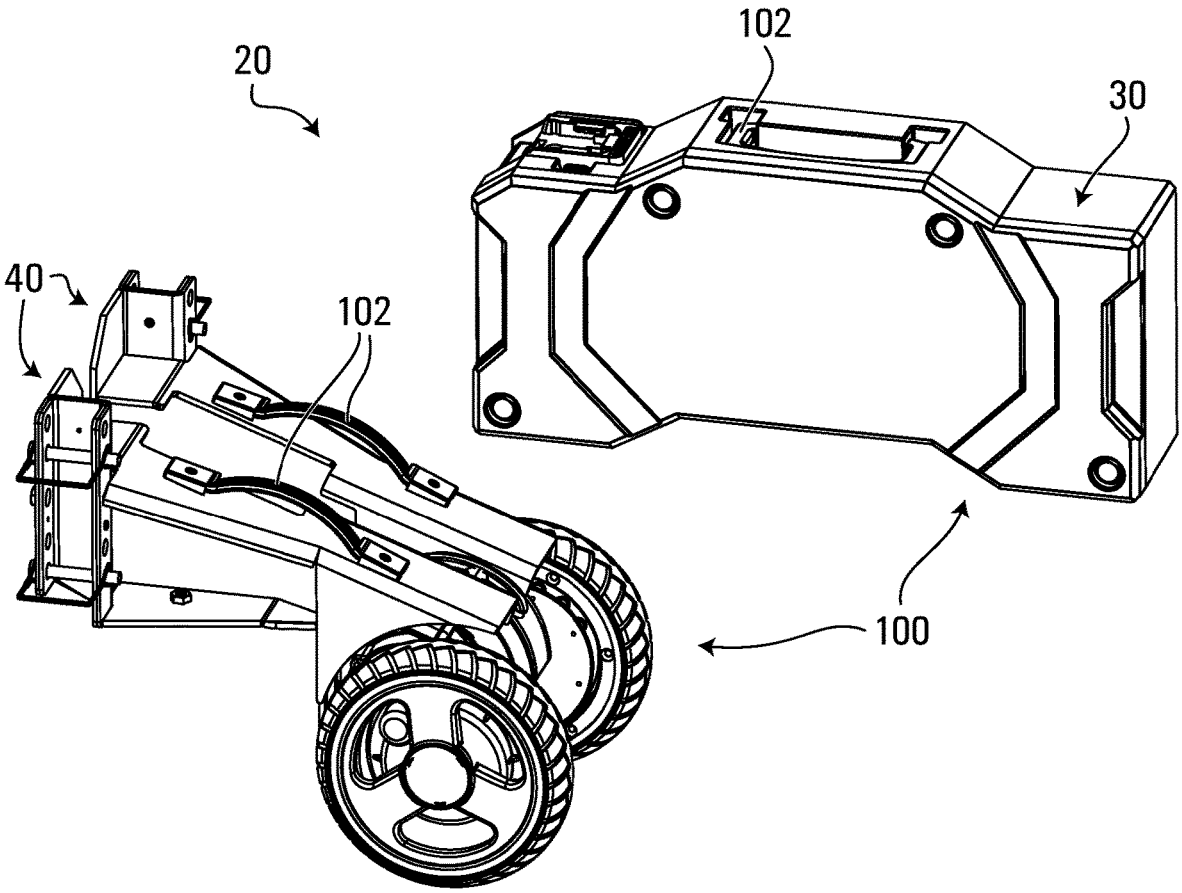
FIG. 36 shows the scaffold motorization system of FIG. 1 uninstalled from the mobile scaffold of FIG. 1 and collapsed into distinct units.
Figure 37:
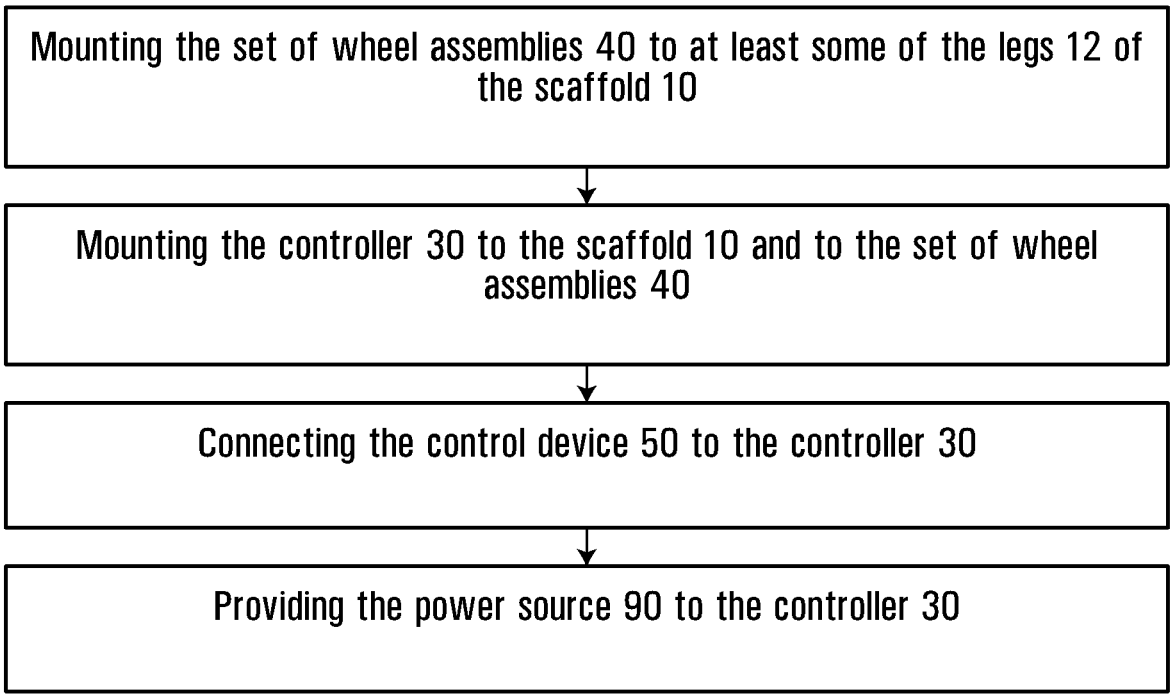
FIG. 37 shows a method of installing the scaffold motorization system of FIG. 1 on the mobile scaffold of FIG. 1.
Figure 38:
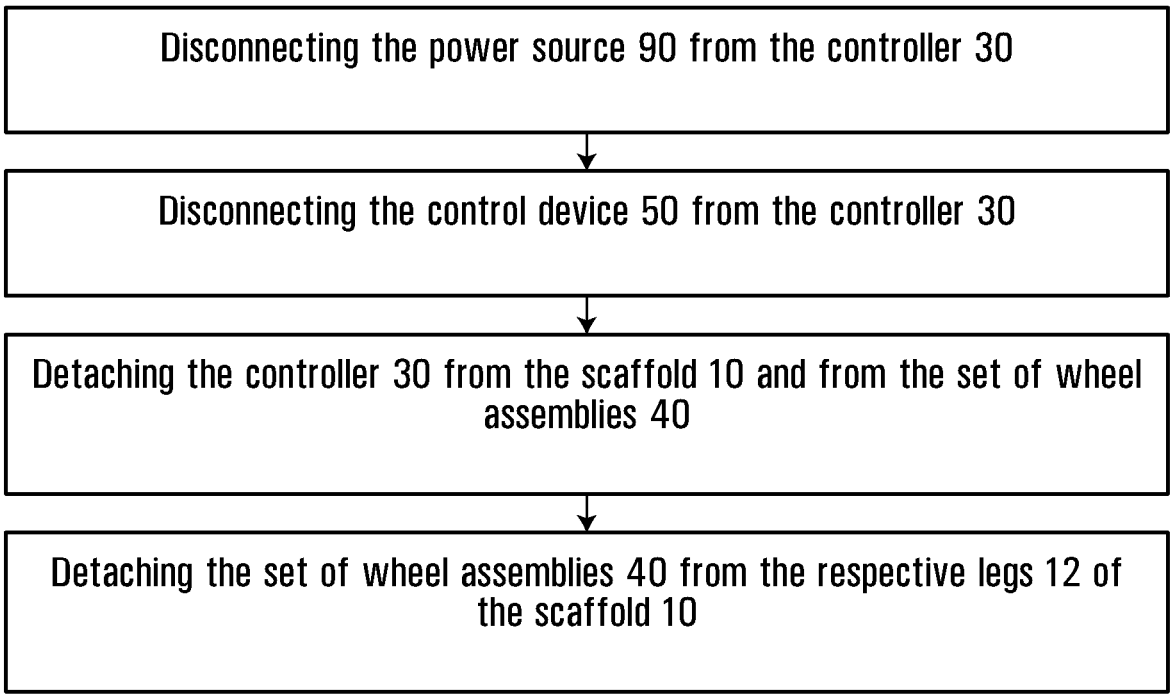
FIG. 38 shows a method of removing the scaffold motorization system of FIG. 1 from the mobile scaffold of FIG. 1.

In this embodiment, the controller 30 comprises a connector 92 to connect the controller 30 to the battery 90. As shown in FIGS. 30 to 32, the connector 92 may comprise a base 94 provided on the controller 30 and a selected one of a plurality of power adapters 96, each power adapter 96 being connectable with a specific battery type. Each power adapter 96 may be removably attached to the base 94 in any suitable way. More specifically, in this embodiment, each power adapter 96 may be fastened to the base 94 be being screwed to the base 94. The base 94 may also comprise projections and recesses, and each power adapter 96 may comprise complementary projections and recesses configured to engage the projections and recesses of the base 94 to further hold the power adapter 96 to the base 94. As shown in FIG. 33, when not in use, each power adapter 96 may be stored in the casing 32 of the controller 30, for instance by being removably fastened (e.g., screwed) into specific storage locations.

In this embodiment, the scaffold motorization system 20 is detachable from the scaffold 10. Furthermore, once detached from the scaffold 10, the scaffold motorization system is collapsible into at least one unit 100 that is easily transportable. In particular, the casing 32 of the controller 30 may define an internal storage space configured to store the controller 30 and other accessories (such as power cables, the power adapters 96, communication wires, the control device 50, etc.) during transportation. The unit 100 may comprise the controller 30, including the casing 32 and the controller, and the accessories stored in the internal storage space of the casing 32.

In this embodiment, each wheel assembly 40 may form one or more units. For instance, in some embodiments, the wheel assemblies 40 are attachable to one another to form a single unit 100. In other embodiments, each wheel assembly 40 forms a distinct unit 100.

As such, in total, the scaffold motorization system 20 may be collapsible into two or three distinct units 100.

The units 100 are configured to be portable. More particularly, each unit may be individually transportable by a person, and more specifically carriable by hand. To this hand, each unit 100 may comprise a handle 102 allowing the operator to carry the unit 100 manually. Specifically, in this embodiment, the controller 30 comprises a handle 102 affixed to the casing 34 and each wheel assembly 40 comprises a handle 102 affixed to the frame 42.

The units 100 are configured to facilitate manual transportation. For instance, in some embodiments, each unit 100 may weight less than 25 kg, in some embodiments less than 20 kg, in some embodiments less than 15 kg, in some embodiments less than 10 kg, and in some embodiments even less. In some embodiments, each unit 100 may occupy a volume less than 250 L, in some embodiments less than 150 L, in some embodiments less than 50 L, and in some embodiments even less.

In this embodiment, the scaffold motorization system 20 may be viewed as an accessory which can be installed to and removed from the scaffold 10 at will, thus facilitating logistics.

In particular, in this embodiment, the scaffold motorization system 20 may be installed on the scaffold 10 by:

- mounting the set of wheel assemblies 40 to at least some of the legs 12 of the scaffold 10;
- mounting the controller 30 to the scaffold 10 and to the set of wheel assemblies 40; and
- providing the power source 90 to the controller 30.

In some embodiments, the installation may comprise additional steps. For instance, in this embodiment, the installation may comprise an additional step of connecting the control device 50 to the controller 30.

Reversely, the scaffold motorization system 20 may be removed from the scaffold 10 by:

- detaching the controller 30 from the scaffold 10 and from the set of wheel assemblies 40; and
- detaching the set of wheel assemblies 40 from the respective legs 12 of the scaffold 10.

In some embodiments, the removal may comprise additional steps of disconnecting the power source 90 from the controller 30, and disconnecting the control device 50 from the controller 30.

In this embodiment, the scaffold motorization system 20 can be installed on the scaffold 10 and/or removed from the scaffold 10 without removing the caster wheels 16 from the scaffold 10. In particular, the set of wheel assemblies 40 may be configured to be releasably mounted to respective legs 12 without removing the caster wheels 16 from the scaffold 10. This is advantageous since it renders installation easier and quicker, and allows the scaffold motorization system 20 to be adaptable to different models of scaffold.

Furthermore, in this embodiment, the scaffold motorization system 20 can be installed on the scaffold 10 and/or removed from the scaffold 10 toollessly, i.e., without using any tools. This is also advantageous since it renders installation easier and quicker.

While a detailed description of embodiments of the scaffold motorization system 20 according to the present disclosure has been presented in detail with reference to FIGS. 1 to 38, various alternative embodiments of scaffold motorization system of the type contemplated in the present disclosure may be considered by persons skilled in the art.

For example, in some embodiments, each wheel assembly 40 may be configured to be installed on a rear one of the legs 12. In this example, each wheel 46 may be configured to be installed in front of a caster 16 of the scaffold 10.

As another example, in some embodiments, each wheel 46 may configured to be installed outwards of the casters 14. For instance, each wheel 46 may configured to be installed in front of the front one of the casters 14 of the scaffold 10 and/or on an outer side of the casters 14 of the scaffold 10 such that the span S is larger than the width W of the scaffold 10 when the scaffold motorization system 20 is installed on the scaffold 10. This may, for example, increase a stability of the scaffold assembly 2.

Figure 29:
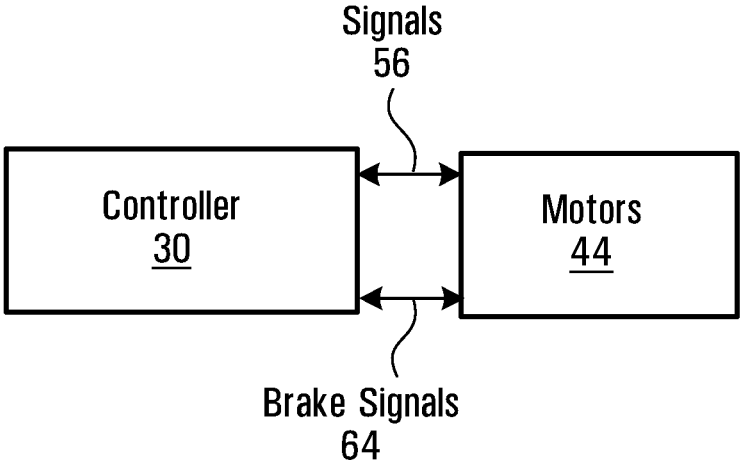

As another example, as shown in FIG. 29, in some embodiments, the motor 44 of each wheel assembly 40 may be lockable and may act as an active brake and, as such, the wheel assembly 40 may be free of a distinct brake 70. The movement signals 64 may be conveyed to the motor 44 based on the command 54 of the control device 50. The active lock of the motor 44 may be configured to be actuated when no signal is transmitted to the motor 44 such that the active lock of the motor 44 is actuated at rest and prevents the wheel 46 from moving. The active lock of the motor 44 may be configured to disengage in response to receiving the movement signals 64 to allow powering the wheel 46.

Figure 39A:
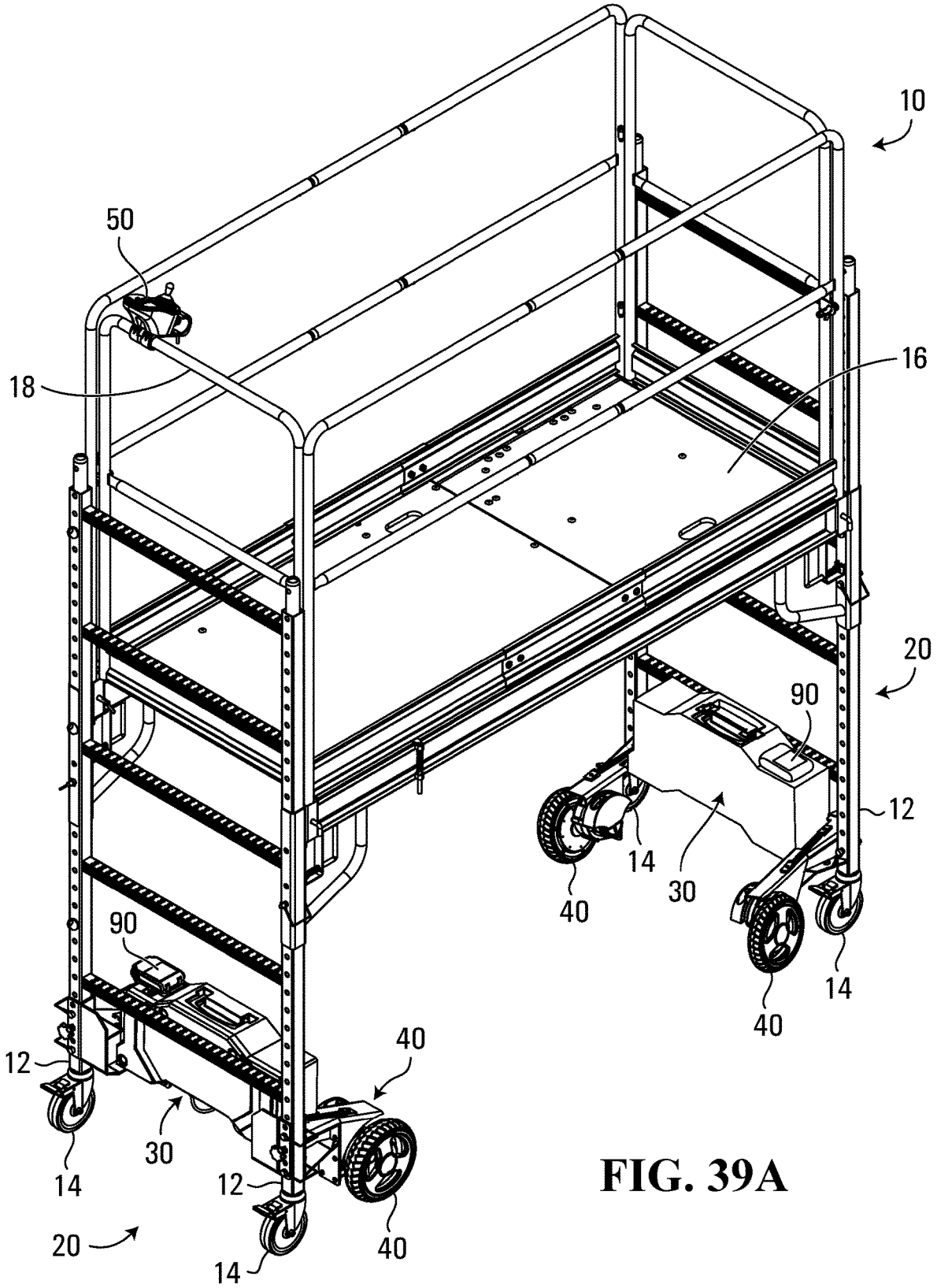
FIGS. 39A and 39B show other embodiments of the scaffold assembly with the scaffold motorization system comprising two pairs of wheel assemblies.
Figure 39B:
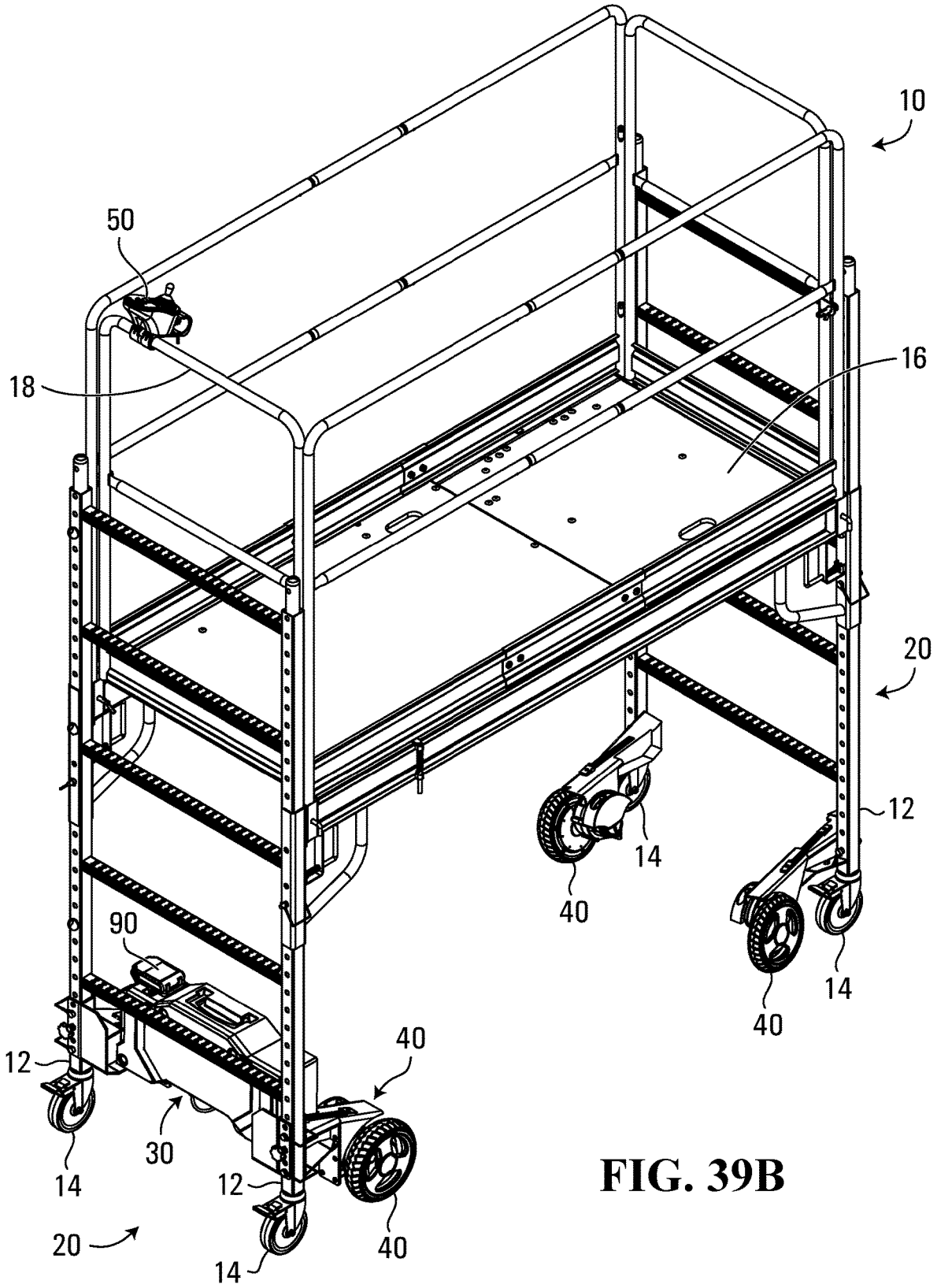

As another example, as shown in FIGS. 39A and 39B, in some embodiments, the scaffold motorization system 20 may comprise four wheel assemblies 40. More specifically, the scaffold motorization system 20 may comprise a first pair of wheel assemblies 40 connected to a front pair of legs 12 of the scaffold 10, and a second pair of wheel assemblies 40 connected to a rear pair of legs 12 of the scaffold 10. Each of the first pair of wheel assemblies 40 and the second pair of wheel assemblies 40 may be similar to the wheel assemblies 40 described above with respect to FIGS. 1 to 38, and may comprise at least one (e.g., one, two) motor 44. In this example, however, at least one pair of wheel assemblies 40 may be steerable about a vertical steering axis to facilitate turning the scaffold assembly 2. For instance, in some cases, the rear pair of wheel assemblies 40 may comprise a pivot and each wheel 46 of the rear pair of wheel assemblies 40 may be free to steer about a vertical axis during turns. In some cases, the front pair of wheel assemblies 40 may comprise a steering device configured to steer each wheel 46 of the front pair of wheel assemblies 40 to turn the scaffold assembly 2.

In some cases, as shown in FIG. 39A, the scaffold motorization system may comprise two controllers 30. More precisely, the controllers 30 may comprise a front controller mounted between the first pair of wheel assemblies 40 for controlling the at least one motor 44 of the first pair of wheel assemblies 40, and a second controller mounted between the second pair of wheel assemblies 40 for controlling the at least one motor 44 of the second pair of wheel assemblies 40. In this example, the controllers 30 may be in communication with one another, e.g., using a wireless connection (e.g., using a WiFi connection, a Bluetooth connection, 4G, 5G, an IoT, a UPnP protocol, etc.). In some cases, as shown in FIG. 39B, the scaffold motorization system 20 may comprise a single controller 30. In this case, the controller 30 may be mounted between one of the first pair of wheel assemblies 40 and the second pair of wheel assemblies 40 and may be configured to control the at least one motor 44 of the first pair of wheel assemblies 40 and the at least one motor 44 of the second pair of wheel assemblies 40.

Figure 40:
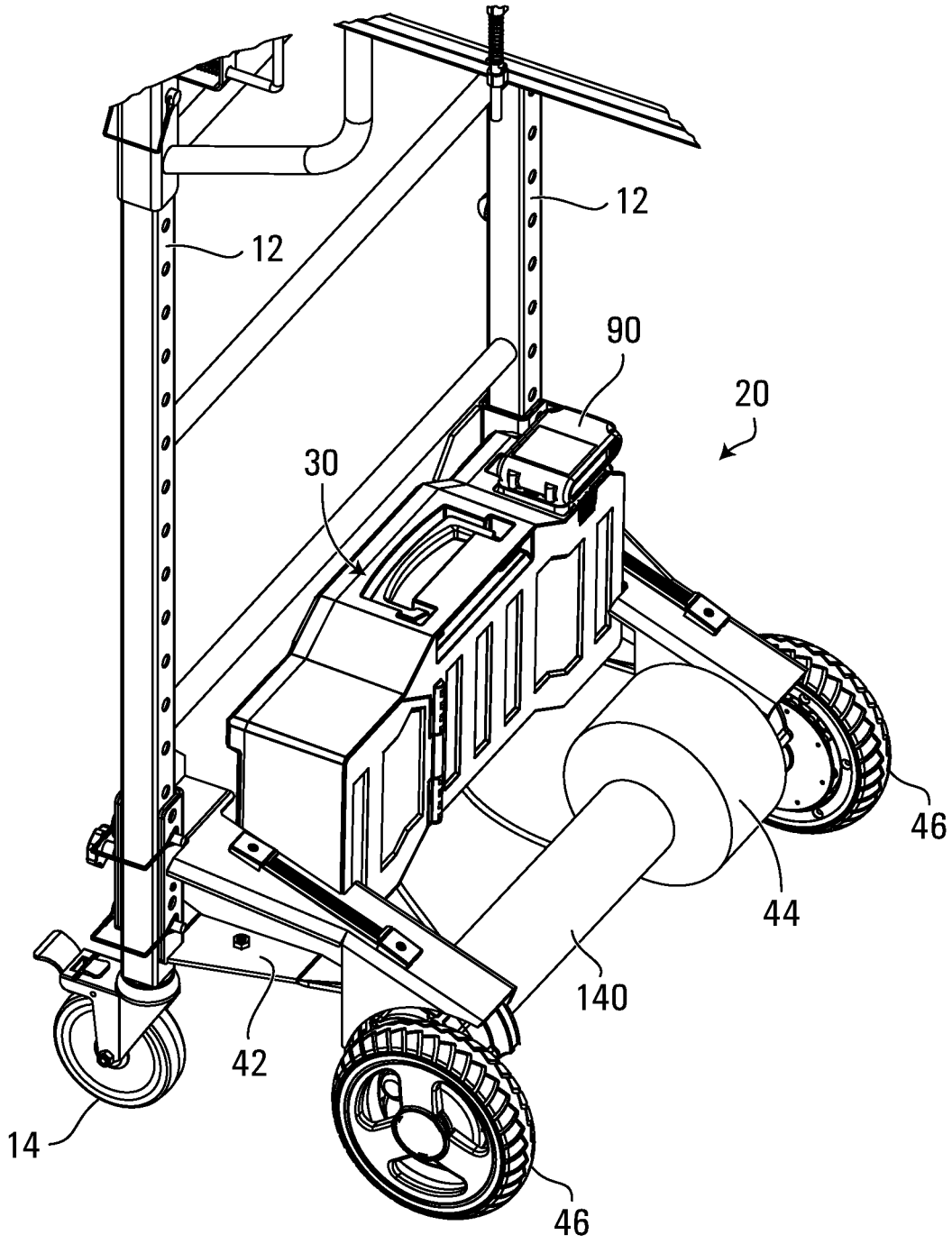
FIG. 40 shows another embodiment of the scaffold assembly with the scaffold motorization system comprising a single motor for a pair of wheel assemblies.

As another example, as shown in FIG. 40, in some embodiments, a pair of wheel assemblies 40 may comprise a single motor 44. For instance, in this example, a first one of the wheel assemblies 40 may comprise a motor 44, while a second one of the wheel assemblies 400 may be free of motor. The scaffold motorization system 20 may comprise a shaft 140 mechanically engaging the wheel 46 of the second wheel assembly 40 with the motor 44 of the first wheel assembly, such that the motor of the first wheel assembly drives the wheels 46 of both wheel assemblies. In this example, the pair of wheel assemblies 40 may be steerable about a vertical steering axis to facilitate turning the scaffold assembly 2. For instance, in some cases, the front pair of wheel assemblies 40 may comprise a steering device configured to steer each wheel 46 of the front pair of wheel assemblies 40 to turn the scaffold assembly 2.

In some embodiments, any feature of any embodiment described herein may be used in combination with any feature of any other embodiment described herein.

Certain additional elements that may be needed for operation of certain embodiments have not been described or illustrated as they are assumed to be within the purview of those of ordinary skill in the art. Moreover, certain embodiments may be free of, may lack and/or may function without any element that is not specifically disclosed herein.

It will be understood by those of skill in the art that throughout the present specification, the term "a" used before a term encompasses embodiments containing one or more to what the term refers. It will also be understood by those of skill in the art that throughout the present specification, the term "comprising", which is synonymous with "including," "containing," or "characterized by," is inclusive or open-ended and does not exclude additional, un-recited elements or method steps. As used in the present disclosure, the terms "around", "about" or "approximately" shall generally mean within the error margin generally accepted in the art. Hence, numerical quantities given herein generally include such error margin such that the terms "around", "about" or "approximately" can be inferred if not expressly stated.

In describing embodiments, specific terminology has been resorted to for the sake of description, but this is not intended to be limited to the specific terms so selected, and it is understood that each specific term comprises all equivalents. In case of any discrepancy, inconsistency, or other difference between terms used herein and terms used in any document incorporated by reference herein, meanings of the terms used herein are to prevail and be used.

References cited in the specification, if any, are hereby incorporated by reference in their entirety for all purposes.

Although various embodiments of the disclosure have been described and illustrated, it will be apparent to those skilled in the art in light of the present description that numerous modifications and variations can be made. The scope of the invention is defined more particularly in the appended claims.

The invention claimed is:

1. A scaffold motorization system for motorizing a scaffold, the scaffold including a platform and a set of legs mounted on casters supporting the platform, the scaffold motorization system comprising:

a. a set of wheel assemblies configured to be releasably mounted to at least some caster mounted legs in the set of legs of the scaffold, the set of wheel assemblies including a set of wheels and at least one motor configured to drive wheels in the set of wheels in a forward direction and a backward direction, wherein the set of wheel assemblies are configured to be releasably mounted to the at least some caster mounted legs in the set of legs of the scaffold without removing the casters; and b. a controller in communication with the set of wheel assemblies for controlling the least one motor to drive the wheels in the set of wheels at least in part in response to control signals received from a control device operated by a person, wherein, in response to control signals conveying specific commands received from the control device, the controller is configured to transform the specific commands into corresponding electric signals to power the at least one motor to drive the wheels in the set of wheels in at least one of the forward direction and the backward direction.

2. The scaffold motorization system of claim 1, wherein the set of wheel assemblies includes at least two wheel assemblies.

3. The scaffold motorization system of claim 2, wherein the at least one motor includes at least two motors, each motor of the at least two motors being connected to a respective wheel assembly from the at least two wheel assemblies.

4. The scaffold motorization system of claim 3, wherein the controller is configured to transform the specific commands into distinct electric signals independently powering each of the at least two motors in one of the forward direction and the backward direction.

5. The scaffold motorization system of claim 3, wherein the specific commands comprise a forward movement command.

6. The scaffold motorization system of claim 3, wherein the specific commands comprise a rotation command.

7. The scaffold motorization system of claim 6, wherein each of the at least two motors are powered at different speeds in response to the rotation command.

8. The scaffold motorization system of claim 6, wherein the at leas two motors are powered in opposite directions in response to the rotation command.

9. The scaffold motorization system of claim 1, wherein the set of wheel assemblies comprises brakes configured to selectively prevent motion of the set of wheels of the set of wheel assemblies.

10. The scaffold motorization system of claim 9, wherein the brakes are configured to prevent motion of the set of wheels absent a signal being transmitted to the brakes from the controller such that the brakes are actuated at rest.

11. The scaffold motorization system of claim 1, comprising a connector to connect the controller to the power source.

12. The scaffold motorization system of claim 11, wherein the power source is a battery.

13. The scaffold motorization system of claim 1, wherein each wheel of the set of wheels is configured to be installed rearwards to a front one of the casters of the at least some caster mounted legs in the set of legs of the scaffold.

14. The scaffold motorization system of claim 1, wherein the wheels of the set of wheels are configured to be spaced apart by a span that is no longer than a width of the scaffold when the scaffold motorization system is installed on the scaffold.

15. The scaffold motorization system of claim 1, wherein each wheel assembly in the set of wheel assemblies comprises a frame having a connector for mounting the frame to a respective leg of the scaffold.

16. The scaffold motorization system of claim 1, wherein the scaffold motorization system is releasable from the scaffold.

17. The scaffold motorization system of claim 1, wherein the scaffold motorization system is collapsible into at least one portable unit.

18. The scaffold motorization system of claim 17, wherein the unit comprises a handle allowing an operator to carry the unit manually.

19. A scaffold comprising;

a platform;

a set of legs mounted on casters and supporting the platform; and a scaffold motorization system for motorizing the scaffold, the scaffold motorization system comprising:

a. a set of wheel assemblies configured to be releasably mounted to at least some caster mounted legs in the set of legs of the scaffold, the set of wheel assemblies including a set of wheels and at least one motor configured to drive wheels in the set of wheels in a forward direction and a backward direction, wherein the set of wheel assemblies are configured to be releasably mounted to the at least some caster mounted legs in the set of legs of the scaffold without removing the casters; and b. a controller in communication with the set of wheel assemblies for controlling the at least one motor to drive the wheels in the set of wheels at least in part in response to control signals received from a control device operated by a user, wherein, in response to control signals conveying specific commands received from the control device, the controller is configured to transform the specific commands into corresponding electric signals to power the at least one motor to drive the wheels in the set of wheels in at least one of the forward direction and the backward direction.

20. A method of motorizing a scaffold using a removable scaffold motorization system, the scaffold including one or more platforms and a set of legs supporting the one of more platforms, legs in the set of legs being mounted on casters, the removable scaffold motorization system comprising:

a. a set of wheel assemblies configured to be releasably mounted to at least some legs in the set of legs of the scaffold, the set of wheel assemblies including a set of wheels and at least one motor configured to drive wheels in the set of wheels in a forward direction and a backward direction, and wherein the set of wheel assemblies are configured to be releasably mounted to the at least some caster mounted legs in the set of legs of the scaffold without removing the casters; and b. a controller in communication with the set of wheel assemblies for controlling the least one motor to drive the wheels in the set of wheels at least in part in response to control signals received from a control device operated by a person;

the method comprising the steps of:

mounting the set of wheel assemblies to at least some of the legs of the scaffold;

mounting the controller to the scaffold and to the set of wheel assemblies; and providing a power source to the controller, wherein the controller is configured to receive control signals conveying specific commands received from a control device, the controller being configured to transform the specific commands into corresponding electric signals to power the one of more motors to drive the wheels in the set of wheels in at least one of the forward direction and the backward direction.

* * * * *